US007124898B2

(12) United States Patent
Richter et al.

(10) Patent No.: US 7,124,898 B2
(45) Date of Patent: Oct. 24, 2006

(54) MERCHANDISING SYSTEM

(75) Inventors: Gary M. Richter, Waukesha, WI (US); Allen E. Johnson, Hartford, WI (US); M. Scott Bryson, Brookfield, WI (US); Daniel J. Schiffer, Menomonee Falls, WI (US); Terrence G. Berglund, Hales, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 0 days.

(21) Appl. No.: 10/996,170

(22) Filed: Nov. 23, 2004

(65) Prior Publication Data

US 2005/0127014 A1 Jun. 16, 2005

Related U.S. Application Data

(63) Continuation of application No. PCT/US04/23791, filed on Jul. 23, 2004, and a continuation-in-part of application No. 10/272,527, filed on Oct. 15, 2002, now Pat. No. 6,886,699, and a continuation-in-part of application No. 10/132,662, filed on Apr. 25, 2002.

(60) Provisional application No. 60/489,676, filed on Jul. 23, 2003, provisional application No. 60/335,924, filed on Oct. 31, 2001, provisional application No. 60/329,656, filed on Oct. 15, 2001, provisional application No. 60/313,894, filed on Aug. 21, 2001, provisional application No. 60/286,892, filed on Apr. 26, 2001.

(51) Int. Cl.
*A47F 1/04* (2006.01)
*A47F 7/00* (2006.01)

(52) U.S. Cl. ..... 211/59.3; 211/59.2; 211/184; 211/74; 211/189

(58) Field of Classification Search ..... 211/59.4, 211/59.2, 59.3, 184, 175, 74, 189, 183; 108/60, 108/61; 312/61, 71, 45, 75
See application file for complete search history.

(56) References Cited

U.S. PATENT DOCUMENTS

| | | | | |
|---|---|---|---|---|
| 2,652,154 | A | | 9/1953 | Stevens |
| 4,685,574 | A | | 8/1987 | Young et al. |
| 4,724,968 | A | | 2/1988 | Wombacher |
| 4,762,236 | A | | 8/1988 | Jackle, III et al. |
| 4,830,201 | A | | 5/1989 | Breslow |
| 4,901,869 | A | | 2/1990 | Hawkinson et al. |
| 5,069,349 | A | | 12/1991 | Wear et al. |
| 5,097,962 | A | | 3/1992 | Eklof et al. |
| 5,199,584 | A | | 4/1993 | Fowler et al. |
| 5,490,600 | A | | 2/1996 | Bustos |
| 5,542,552 | A | | 8/1996 | Yablans et al. |
| 5,577,623 | A | | 11/1996 | Bustos |
| 5,634,564 | A | | 6/1997 | Spamer et al. |
| 5,638,963 | A | | 6/1997 | Finnelly et al. |
| 5,645,176 | A | * | 7/1997 | Jay ..... 211/59.2 |
| 5,685,664 | A | | 11/1997 | Parham et al. |
| 5,788,091 | A | | 8/1998 | Robertson et al. |
| 5,839,588 | A | | 11/1998 | Hawkinson |
| 6,041,720 | A | | 3/2000 | Hardy |
| 6,105,791 | A | | 8/2000 | Chalson et al. |

(Continued)

*Primary Examiner*—Jennifer E. Novosad
(74) *Attorney, Agent, or Firm*—Brian G. Gilpin; Godfrey & Kahn, S.C.

(57) ABSTRACT

A merchandising system for articles comprising a connector, a first divider coupled to the connector, and a second divider coupled to the connector wherein a compartment of a first size is provided when the first divider is coupled to a portion of the connector and the second divider is coupled to a portion of the connector.

26 Claims, 19 Drawing Sheets

U.S. PATENT DOCUMENTS

| | | | | |
|---|---|---|---|---|
| 6,129,218 | A | 10/2000 | Henry et al. | |
| 6,168,032 | B1 | 1/2001 | Merl | |
| 6,227,385 | B1 | 5/2001 | Nickerson | |
| 6,311,852 | B1 | 11/2001 | Ireland | |
| 6,401,942 | B1 * | 6/2002 | Eckert | 211/59.3 |
| 6,409,028 | B1 | 6/2002 | Nickerson | |
| 6,571,498 | B1 | 6/2003 | Cyrluk | |
| 6,585,120 | B1 | 7/2003 | Robertson | |
| 6,622,874 | B1 | 9/2003 | Hawkinson | |
| 6,691,891 | B1 * | 2/2004 | Maldonado | 221/279 |
| 6,715,621 | B1 * | 4/2004 | Boron | 211/59.2 |
| 6,722,509 | B1 * | 4/2004 | Robertson et al. | 211/59.2 |
| 2001/0020606 | A1 * | 9/2001 | Battaglia et al. | 211/59.2 |
| 2002/0170866 | A1 | 11/2002 | Johnson et al. | |
| 2002/0179553 | A1 * | 12/2002 | Squitieri | 211/59.2 |
| 2003/0085187 | A1 | 5/2003 | Johnson et al. | |

* cited by examiner 10c
20c
27c
29c
6B
82c
40c
46c
32c
20c
40c
32c
46c
82c
82c
20c
82c
27c

MERCHANDISING SYSTEM

CROSS-REFERENCE TO RELATED APPLICATIONS

This Application is a continuation of co-pending International Application No. PCT/US04/023791, filed on Jul. 23, 2004, which claims the benefit of U.S. application Ser. No. 60/489,676, filed on Jul. 23, 2003. This Application is a continuation-in-part application of U.S. application Ser. No. 10/272,527, filed Oct. 15, 2002, now U.S. Pat. No. 6,886,699, which claims the benefit of U.S. application Ser. No. 60/329,656, filed on Oct. 15, 2001. This Application is a continuation-in-part application of co-pending U.S. application Ser. No. 10/132,662, filed on Apr. 25, 2002, which claims the benefit of the following patent applications: (1) U.S. application Ser. No. 60/286,892, filed on Apr. 26, 2001, (2) U.S. application Ser. No. 60/313,894, filed on Aug. 21, 2001, (3) U.S. application Ser. No. 60/329,656, filed on Oct. 15, 2001, and (4) U.S. application Ser. No. 60/335,924, filed on Oct. 31, 2001.

This Application claims the benefit of priority as available under 35 U.S.C. §§ 119-121 and 365 to the following Patent Applications (which are hereby incorporated by reference in the present Application): (1) International Application No. PCT/US04/023791, filed on Jul. 23, 2004; (2) U.S. application Ser. No. 10/272,527, filed Oct. 15, 2002; (3) U.S. application Ser. No. 10/132,662, filed on Apr. 25, 2002; (4) U.S. application Ser. No. 60/489,676, filed on Jul. 23, 2003; (5) U.S. application Ser. No. 60/286,892, filed on Apr. 26, 2001; (6) U.S. application Ser. No. 60/313,894, filed on Aug. 21, 2001; (7) U.S. application Ser. No. 60/329,656, filed on Oct. 15, 2001; and (8) U.S. application Ser. No. 60/335,924, filed on Oct. 31, 2001.

FIELD

The present invention relates to merchandising systems and methods. In particular, the present invention relates to a merchandising system providing for orderly presentation, display, storage, arrangement, and dispensing of articles.

BACKGROUND

It is known to provide for merchandising systems that may be used for displaying and dispensing an article. Such merchandising systems do not realize certain advantageous features (and/or combinations of features). It is also known to provide for a merchandising system that may be used for displaying products in consumer settings such as grocery stores, retail outlets, shops, etc. Such known merchandising systems may be used to present, display and store products in fixed or limited spaces such as on shelves, in display cases, in cabinets, etc.

It is beneficial when merchandising an article such as a product to allow potential customers to view or handle it in a convenient and comfortable manner. Known merchandising systems may display products to a consumer by providing the products in inefficient configurations. Products and product containers come in a variety of sizes and shapes, and some products may be more difficult to merchandise (e.g., present for potential retail sale) than others. Within fixed or limited spaces, known merchandising systems may not be configured to optimize the presentation of such products to a consumer. Such known merchandising systems also do not always provide convenient ways for dispensing products, especially those with unique or irregular shapes. Ease of use can be an important concern for customers and store personnel. As is sometimes the case, product or container design may be dictated by considerations separate from the ease or difficulty with which the product may be presented.

Some known merchandising systems may not provide effective arrangements for displaying, storing and presenting articles. Some merchandising systems fail to provide adequate support for articles, as well as smooth, efficient sliding of the article along the length of the system. Some merchandising systems do not provide sufficient arrangements of advancing these types of articles along the merchandising system. Some merchandising systems do not provide strong and/or rigid support for articles. Accordingly, many merchandising systems may not provide articles in a straight, linear, or level arrangement due to sagging, deformation, bowing, deflection and/or movement due to the weight of the articles. In addition, some merchandising systems do not provide for a variety of differently sized articles and are not configured to operate with a variety of shelving structures. Some merchandising systems do not retain articles for proper dispensing. Some merchandising systems are not easily repositionable on a shelving structure. Some known merchandising systems are not configured for easy loading or removal of articles or for at least partially restricting movement of the articles along the system. In addition, some known merchandising systems are not configured to allow multiple products to be stacked on one another. Some known merchandising systems are not configured to prevent articles from sliding in an uncontrolled manner along the length of the system. Some known merchandising systems are not configured to prevent articles from tipping and/or falling from the system, especially during movement of the articles.

Accordingly, it would be advantageous to provide a merchandising system that is configured for stocking, orderly presentation, and convenient storage of products with various shapes including shapes that may not be easily stored, presented, or displayed, such as products with uniquely shaped containers. It would also be advantageous to provide a merchandising system that is configured for selective modularity in the construction and assembly of the merchandising system. It would further be advantageous to provide a merchandising system that allows for the construction and assembly of a merchandising system with any number of product facings, modules, compartments, etc. It would further be advantageous to provide a merchandising system that advances a product and/or allows a product to advance along a defined path. It would further be advantageous to provide a merchandising system that self-faces articles (e.g., allows articles to move to the front of the system after articles are removed). It would be advantageous to provide a merchandising system that is configured to easily move articles along a path for stocking, aligning, and/or facing purposes. It would also be advantageous to provide a merchandising system that allows multiple products to be stacked on one another. It would further be advantageous to provide a merchandising system that is configured to at least partially restrict and/or restrain article movement in one or more level. It would further be advantageous to provide a merchandising system that can evenly distribute the weight of articles and/or products over the length of the system. It would further be advantageous to provide a merchandising system that allows for smooth, controlled, and efficient gliding of articles and/or products along the length of the system. It would further be advantageous to provide a merchandising system that prevents articles from tipping and/or falling when provided in the system, especially during movement of the articles.

It would be advantageous to provide a system that provides any one or more of these or other advantageous features.

DETAILED DESCRIPTION

Figure 1:
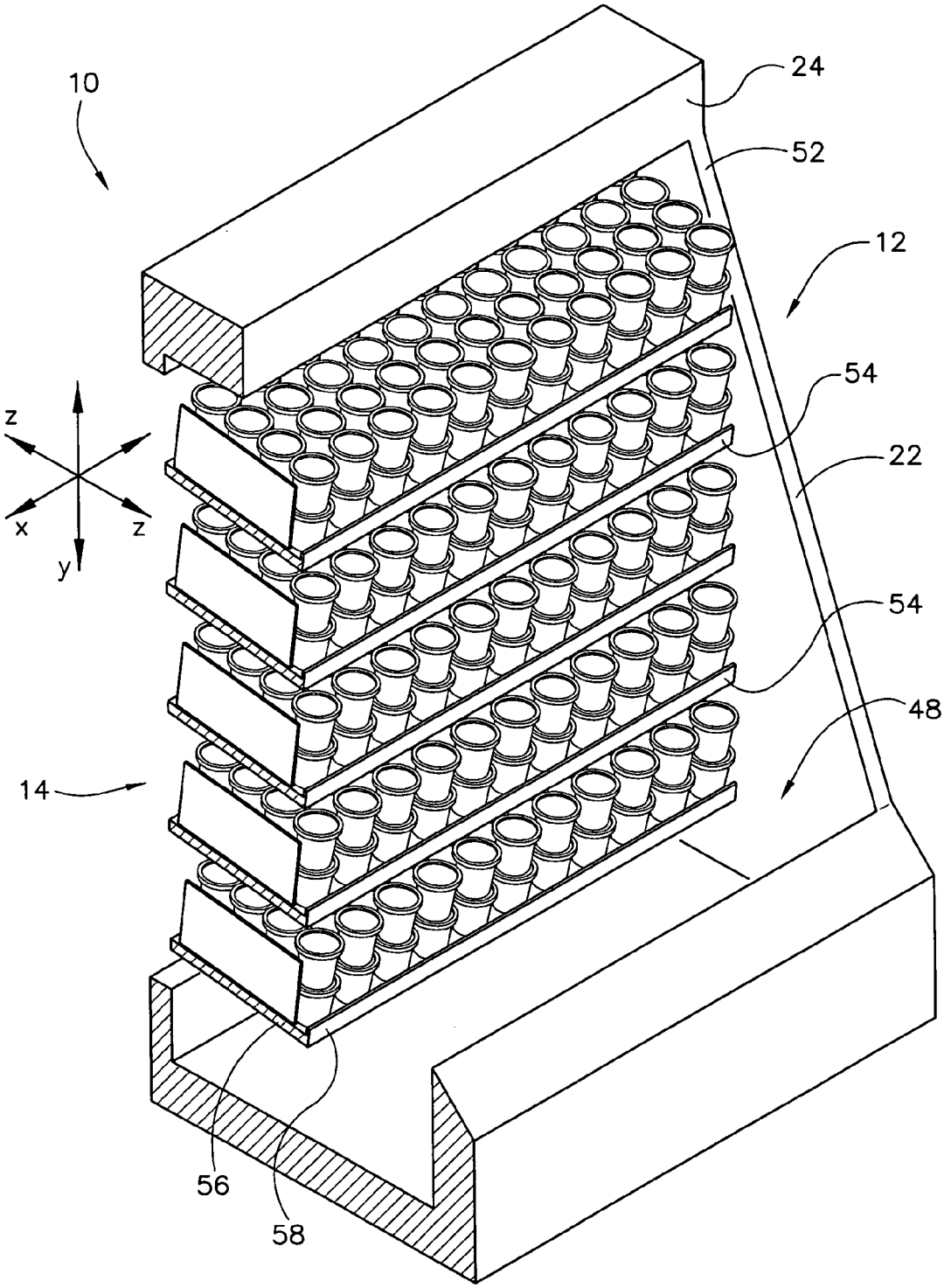
FIG. 1 is a side perspective view of a merchandising system according to an exemplary embodiment.

It is to be understood that the inventions are not limited to the details or methodology set forth in the following description or illustrated in the drawings. The inventions are capable of other embodiments or being practiced or carried out in various ways. It is also to be understood that the phraseology and terminology employed is for the purpose of description and should not be regarded as limiting.

Referring to the FIGURES, exemplary embodiments of a merchandising system are shown. The merchandising system may provide for display, space division, and orderly presentation of products. The merchandising system may provide for selective size (shown as width) adjustment of a product display, "facing," cell, compartment, or display area, while not requiring the width adjustment of adjacent product displays, "facings," cells, compartments, or display areas. As shown in FIG. 1, a merchandising system 10 may provide a large number of facings. Should a single facing need to be adjusted (for example, to accommodate a differently sized product), that single facing may be readily adjusted without the need to resize any (or potentially all) of the remaining facings.

The merchandising system may further provide for modularity in the construction and assembly of the merchandising system. For example, product displays, "facings," cells, compartments, or display areas may be added and/or removed to an existing merchandising system by reconfiguring the number and arrangement of dividers and connectors.

The merchandising system may be a shelf system, shelf divider system, product facing tray system, product self-facing and organization tray system, divider system, shelf tray system, pusher system, dispensing system, tray system, etc. The merchandising system may be provided for use on a shelf (or any portion of a shelf), shelves, racks, displays, or other merchandising systems, or alternatively may be provided as a separate, independent merchandising system. According to other alternative embodiments, the system may be configured or oriented to provide for vertical size (e.g., height) adjustment.

According to an exemplary embodiment shown in FIG. 1, a merchandising system 10 (e.g., grid system, tray system, shelf system, display system, case, divider system, storage system, modular system, etc.) comprises a frame system 12 and a shelving system 14. Frame system 12 (e.g., mounting structure, shelving structure, support, framework, frame, base, bar, grid, housing, storage unit, etc.) comprises a storage unit 52 and a lower portion 48 or section.

As shown in FIG. 1 storage unit 52 (e.g., support, frame, mount, member, wall, grid, unit, container, etc.) or other support is provided for use with frame system 12. According to an exemplary embodiment shown in FIG. 1 storage unit 52 comprises at least one side 22 and a top section 24 (e.g., top portion, section, overhead, roof, housing, cap, cover, etc.). The sides may be provided with one or more aperture and/or slot for providing an arrangement for positioning the shelving system with respect to the frame system. According to alternative embodiments, any suitable device and/or process may be used to secure the shelving system to the frame system. According to various alternative embodiments, a wide variety of storage units, shafts, supports, sides, covers, etc. may be provided in the merchandising system. According to alternative embodiments, the number, size, position, overall configuration, etc. of the storage unit may vary.

As shown in FIG. 1 lower portion 48 (e.g., bottom area or section, concavity, opening, area, basket, basin, reservoir, channel, well, etc.) or other area is provided for use with frame system 12. According to an exemplary embodiment shown in FIG. 1, lower portion 48 comprises an area below sides 22, top section 24 and/or shelving system 14. Lower portion 48 is configured to hold, store and/or display various articles. According to various alternative embodiments, a wide variety of bottom sections, openings, areas, channels, etc. may be provided in the merchandising system. According to alternative embodiments, the number, size, position, overall configuration, etc. of the bottom section may vary.

As shown in FIG. 1, shelving system 14 (e.g., frame, tray, shelf system, holder, mounting section or area, etc.) is provided for use with merchandising system 10. According to an exemplary embodiment shown in FIG. 1, shelving system 14 comprises a shelf 54.

According to an exemplary embodiment shown in FIG. 1, shelf 54 (e.g., support, frame, guide, beam, ledge, bar, etc.) comprises a body portion 56 and a first end 58. Referring to FIG. 1, body portion 56 (e.g., member, straight section or portion, main section or portion, etc.) is configured to receive and support products as provided in various merchandising systems.

Referring to FIG. 1, member or body portion 56 has a generally uniform cross-section and is configured to have a longitudinal axis (from a back end to a front end). According to other embodiments, the body portion may have a cross-section of various shapes (e.g., triangular, rectangular, oval, etc.) and its longitudinal axis may be other than straight (such as curved or arched) and may extend at various angles with respect to the Z—Z axis. Further, the cross-section of the body portion may be non-uniform.

According to an exemplary embodiment shown in FIG. 1, body portion 56 extends at a downward angle with respect to the Z—Z axis (e.g., sloping toward the ground and/or horizontal). The angled configuration enables articles to slide toward first end 58 as other articles are removed from shelf 54. For example, as an article located nearest first end 58 is removed, the next product in line is urged forward by gravity toward first end 58.

Figure 2A:
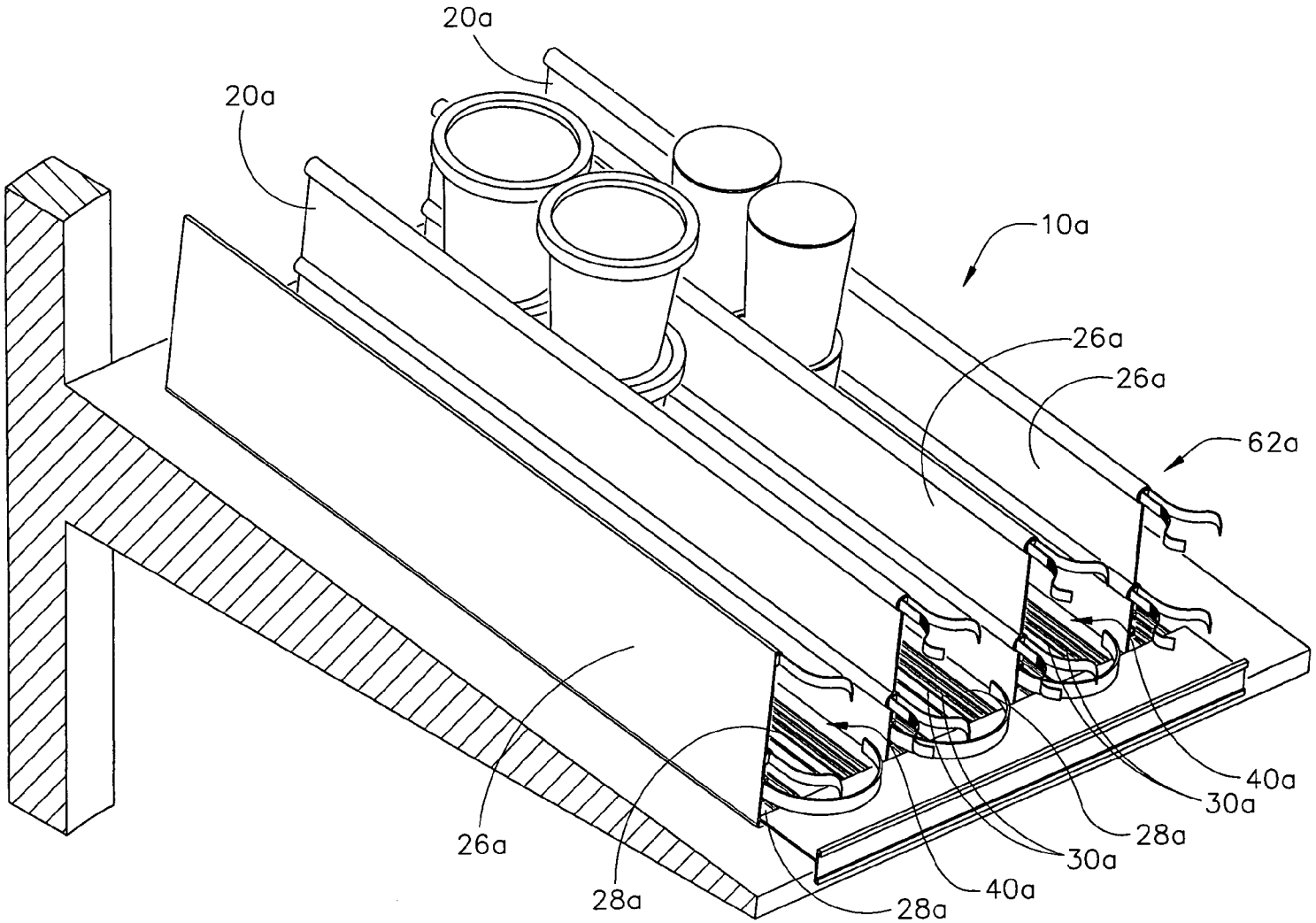
FIG. 2A is a front perspective view of a merchandising system according to an exemplary embodiment.
Figure 2B:
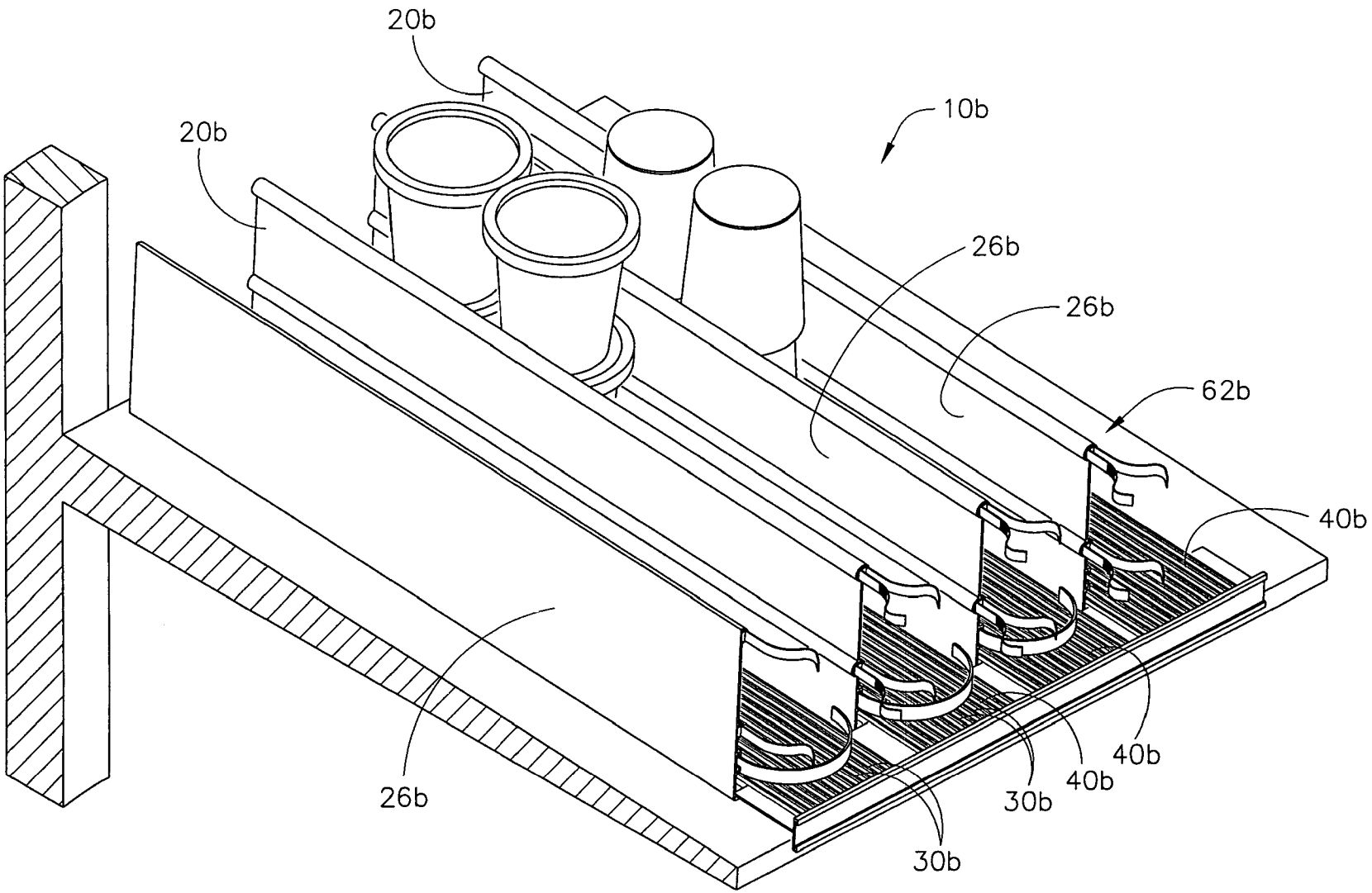
FIG. 2B is a front perspective view of a merchandising system according to an exemplary embodiment.
Figure 2C:
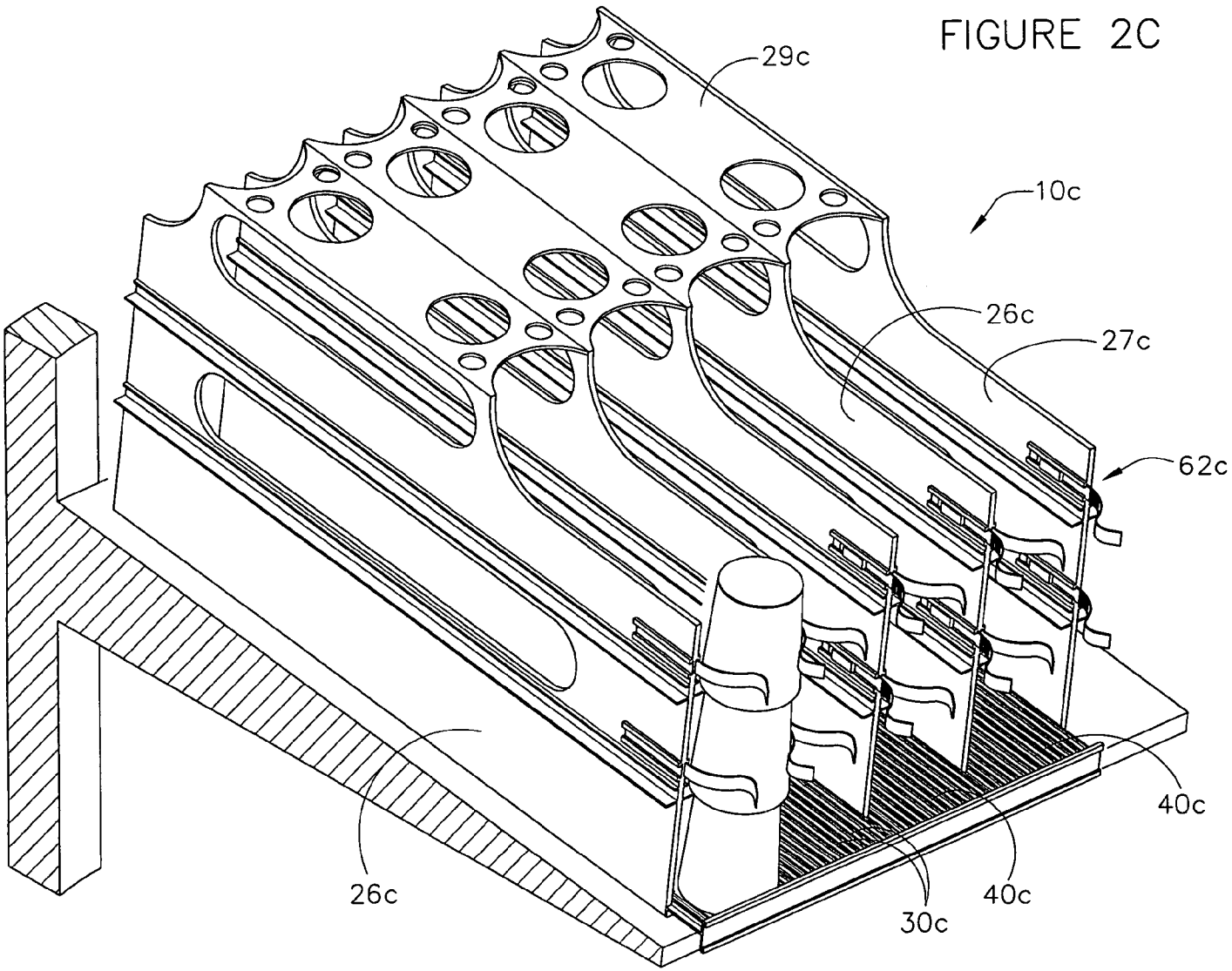
FIG. 2C is a front perspective view of a merchandising system according to an exemplary embodiment.

Shown in FIGS. 2A is a first exemplary embodiment of a merchandising system 10*a*, shown in FIGS. 2B is a second exemplary embodiment of a merchandising system 10*b*, and shown in FIGS. 2C is a third exemplary embodiment of a merchandising system 10*c*, wherein each system may be used with the system described with respect to FIG. 1. As shown, merchandising systems 10*a*, 10*b*, 10*c* have modular configurations that include one or more dividers 20*a*, 20*b*, 20*c* (which may be panels, dividers, separators, divisions, partitions, tracks, extrusions, panels, channels, or other panels or members, frames, supports, walls, partitions, guides, etc.) and one or more connectors 40*a*, 40*b*, 40*c* (which may be interfaces, couplings, connecting members, adjustment members, "combs," connector modules, etc.). Dividers 20*a*, 20*b*, 20*c* provide space division, separation, organization, and merchandise variously sized products (not shown). Adjacent dividers 20*a*, 20*b* are coupled with an intermediate link or connector 40*a*, 40*b*. Adjacent dividers 20*c* are coupled directly to one another.

Dividers 20*a* are shown in FIGS. 2A, 3A, 4A, 4B, 7A, and 8A. Dividers 20*b* are shown in FIGS. 2B, 3B, 5A, 5B, 7B, and 8B. Dividers 20*c* are shown in FIGS. 2C, 3C, 6A, 6B, 7C, and 8C. Dividers 20*a*, 20*b*, 20*c* comprise a panel section (shown as portion 26*a*, 26*b*, 26*c*) and one or more horizontal portions or sections (shown as portions 28*a*, 28*b*, 28*c*). The divider (which may be tracks, extrusions, panels, channels, open frame or rail, etc.) may be provided in a variety of configurations. According to one particularly preferred embodiment, dividers 20*a*, 20*b* include end dividers and center dividers. End dividers have an "L-shaped" cross section. Center dividers have a "T-shaped" cross section. End dividers and center dividers may include solid portions and/or portions that include apertures or cut-outs. Divider 20*a* (shown in FIGS. 2A, 3A, 4A, 4B, 7A, and 8A) and 20*b* (shown in FIGS. 2B, 3B, 5A, 5B, 7B, and 8B) provide a horizontal section, or portion (shown as portions 28*a*, 28*b*), and a panel section, vertical section, division panel or portion (shown as portions 26*a*, 26*b*). Portions 26*a*, 26*b* and 28*a*, 28*b* form a "T-shaped" cross-section. The end dividers comprise one portion 28*a*, 28*b* on one side of portion 26*a*, 26*b* to form an "L-shaped" cross-section. Portion 28*a* is provided with friction reducing ribs or protrusions (shown as ribs 30*a*). Ribs 30*a* provide friction reduction on a product support surface (e.g., portion 28*a*) such that product which is being displayed or supported on merchandising system 10*a* may move more easily along the length of divider 20*a*.

According to an exemplary embodiment shown in FIGS. 2C, 3C, 6A, 6B, 7C, and 8C, divider 20*c* has a "C-shaped" cross-section. Divider 20*c* includes a vertical section or portion 26*c*, a lower horizontal section 28*c*, and an upper horizontal portion 29*c*. Portions 28*c* and 29*c* are configured to attach to portions of adjacent dividers 20*c*. Portions 29*c* provide additional support for system 10*c*. According to various exemplary embodiments, dividers 20*c* may be connected together according to any suitable method (e.g., fasteners, adhesives, sonic welding, etc.). Once a desired number of dividers 20*c* have been connected, a separate wall 27*c* is coupled to the end divider to form system 10*c*. According to various alternative embodiments, any number of devices may be used instead of wall 27*c* (e.g., a separate end divider may be used that includes two side walls, an upper portion, and a lower portion). Portions 29*c*, 26*c*, and wall 27*c* are shown including apertures 31*c*. Apertures 31*c* may be used to reduce the amount of material required to manufacture the system and can reduce production costs. According to an alternative embodiment, dividers 20*c* may be have an "L-shaped" cross-section. Instead of included portions 29*c* which are integrally formed as part of dividers 20*c*, a separate top portion may be provided that couples to the dividers to provide overall structural support to the system. The top portion may couple to the end portions and center portions according to any suitable arrangement (e.g., fasteners, adhesives, sonic welding, etc.). The top portion may align with the end dividers to provide an overall rectangle shape. According to alternative embodiments, any number of shapes may be used (e.g., square, pyramid, curved, etc.).

Figure 4A:
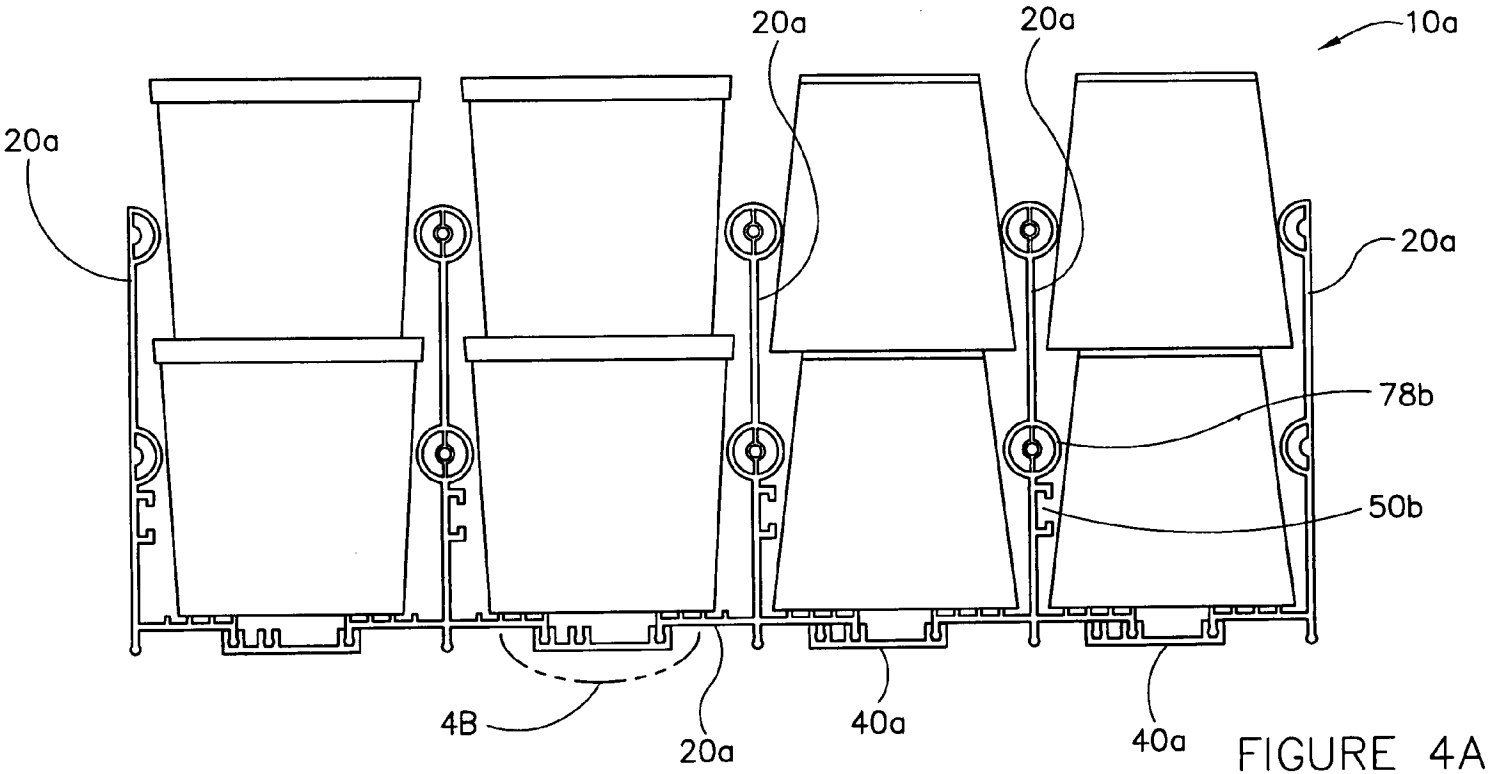
FIG. 4A is an orthogonal front view of the merchandising system of FIG. 2A according to an exemplary embodiment.
Figure 4B:
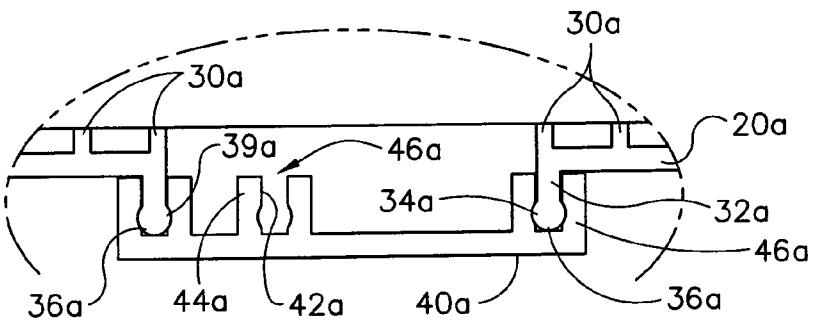
FIG. 4B is a detailed view of a portion of the merchandising system of FIG. 4A according to an exemplary embodiment.
Figure 5A:
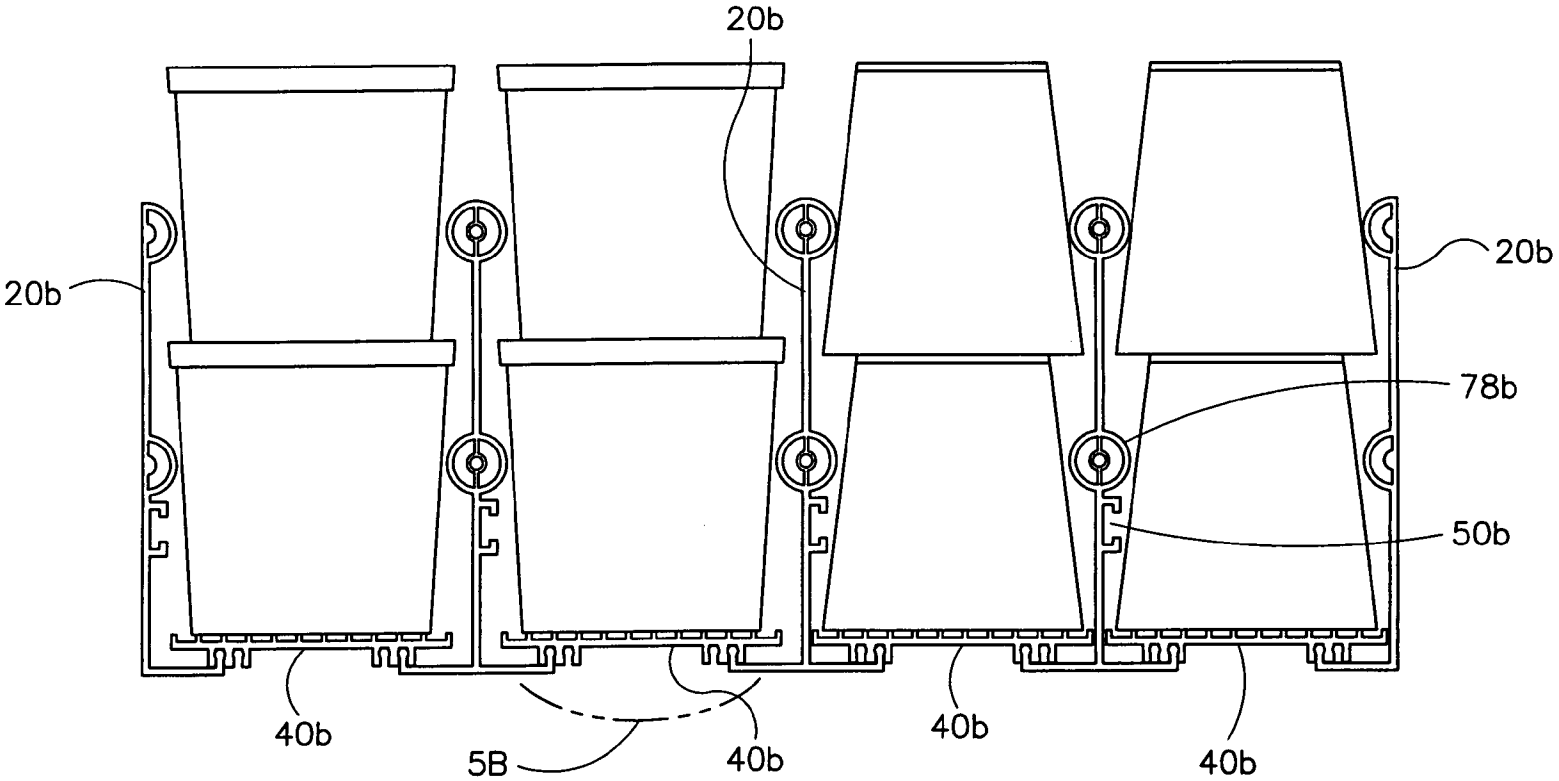
FIG. 5A is an orthogonal front view of the merchandising system of FIG. 2B according to an exemplary embodiment.
Figure 5B:
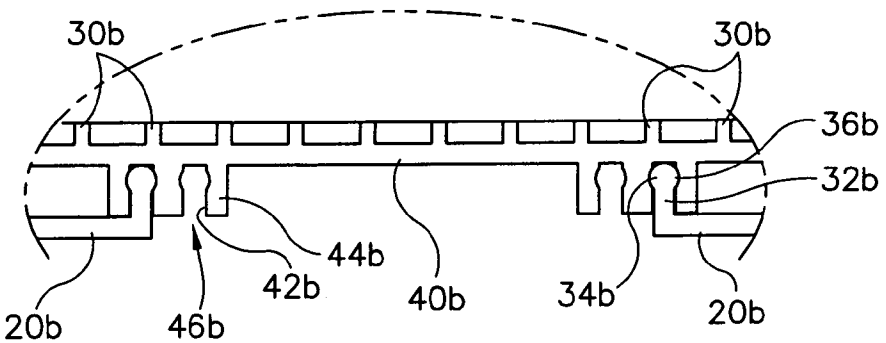
FIG. 5B is a detailed view of a portion of the merchandising system of FIG. 5A according to an exemplary embodiment.

Divider 20*a* further includes one or more engagement portions 32*a* configured to engage, couple, connect, coact or otherwise interface with connector 40*a*. As shown in FIG. 4A, engagement portion 32*a* comprises a projection or leg 34*a* provided on a bottom side of divider 20*a*. Leg 34*a* is configured to engage with connector 40*a*. According to a particularly preferred embodiment, leg 34*a* engages connector 40*a* via a friction-fit or interference-fit. According to another particularly preferred embodiment shown in FIG. 4B, leg 34*a* may be provided with a groove or depression (shown as depression 36*a*) which is configured to interface with a projection 42*a* on a tooth 44*a* of a groove 46*a* of connector 40*a*.

According to a second and third embodiment shown in FIGS. 5A, 5B and 6A, 6B, dividers 20*b* and 20*c* include one or more engagement portions 32*b* and 32*c* on a top side of dividers 20*b* and 20*c*. The bottom sides of dividers 20*b* and 20*c* are configured to lay (e.g., rest) directly on a shelf (e.g., shelf 54 shown in FIG. 1) and do not include engagement portions. Engagement portions 32*b* and 32*c* are configured to engage with grooves 46*b*, 46*c* of connectors 40*b* and 40*c* (e.g., projections 42*b*, 42*c* and teeth 44*b*, 44*c*) and comprise projections or legs 34*b* and 34*c*. According to an alternative embodiment, divider 40*c* may not include engagement portions 32*c*. The connector 40*c* may be configured to lay (e.g., rest) on top of the horizontal surface of the divider and remain movable with respect to the divider. According to this embodiment, the connector does not necessarily include grooves 46*c* and instead may include a flat undersurface that rests on the divider. According to various alternative embodiments, any number of configurations may be utilized.

Figure 3A:
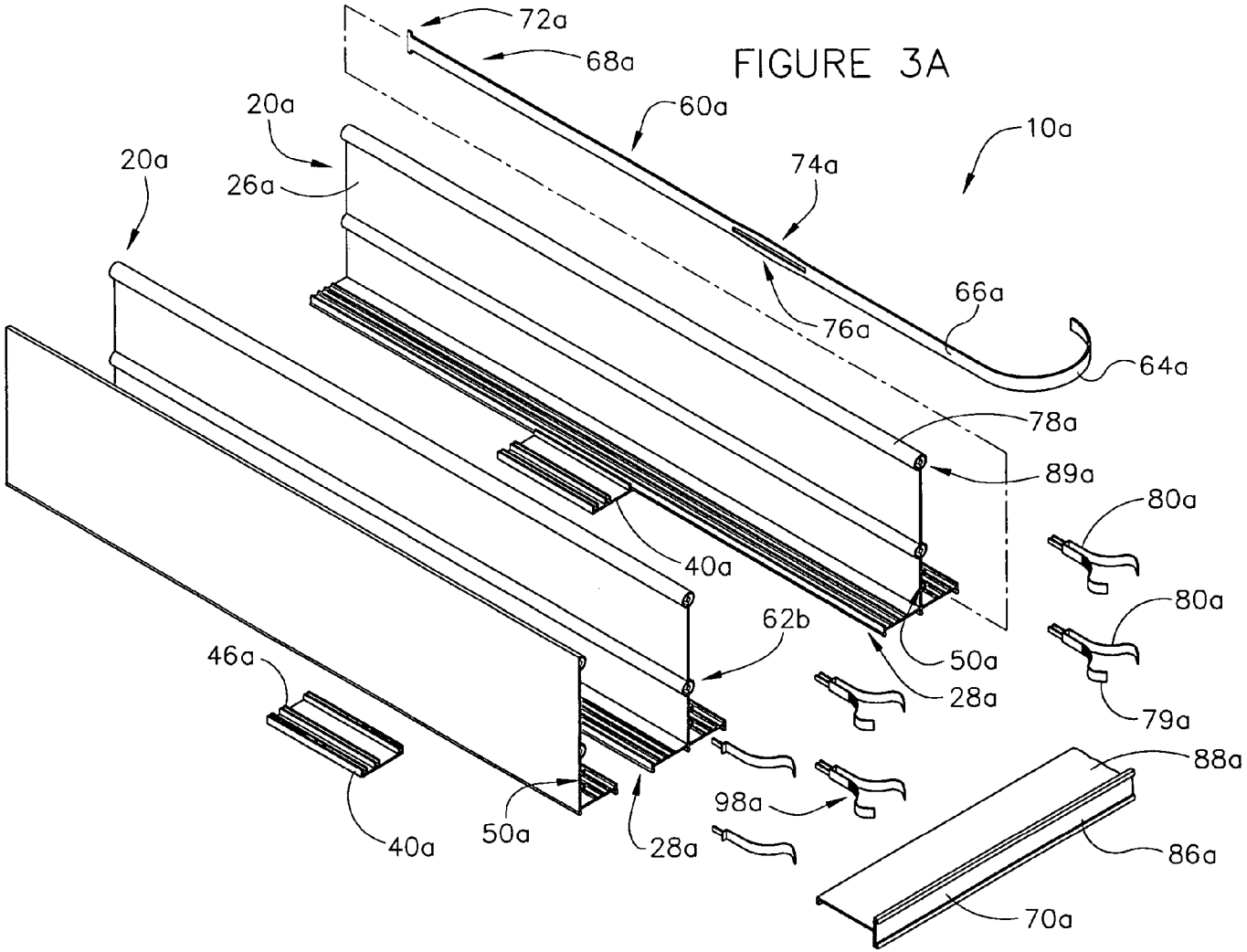
FIG. 3A is an exploded front perspective view of the merchandising system of FIG. 2A according to an exemplary embodiment.
Figure 3B:
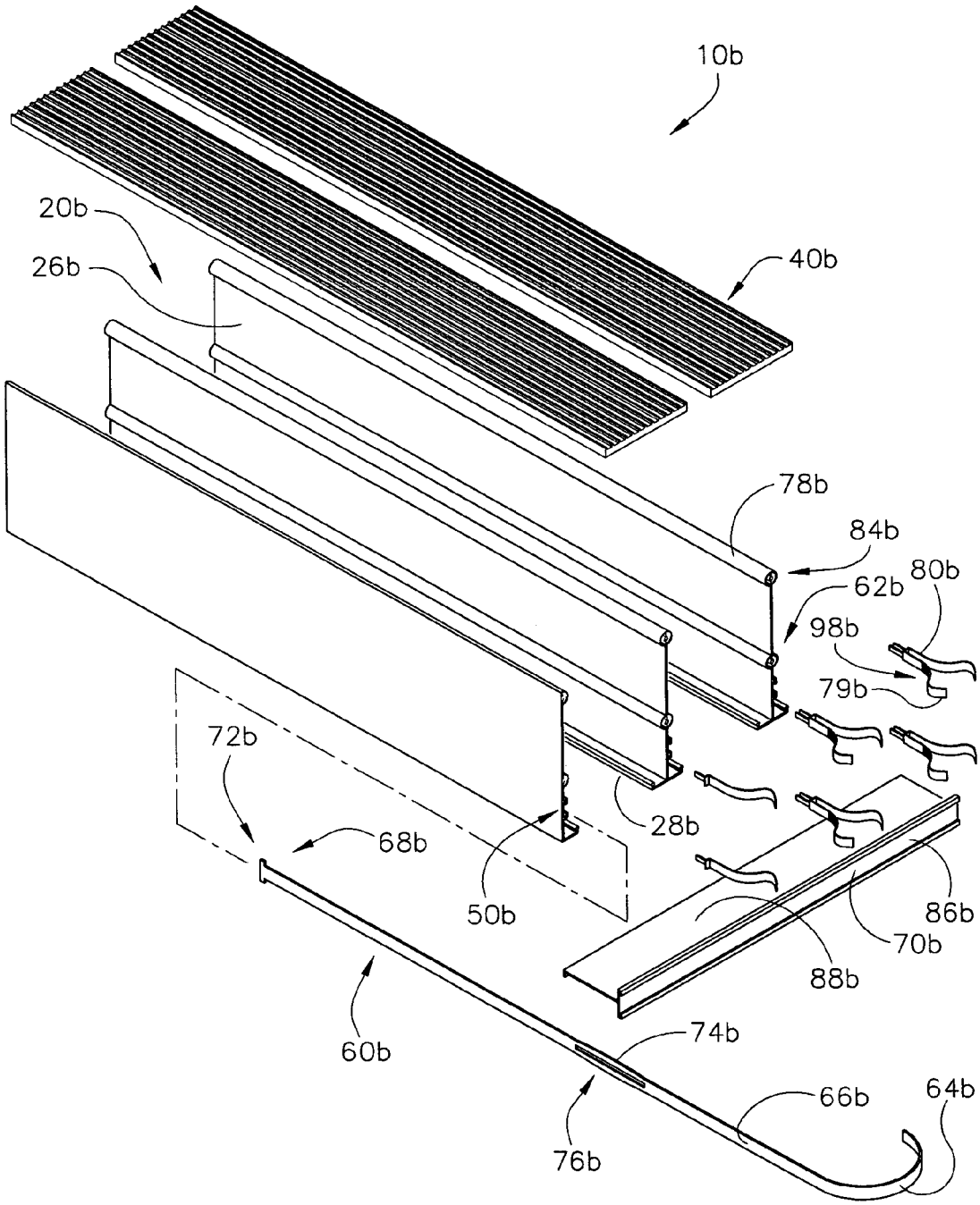
FIG. 3B is an exploded front perspective view of the merchandising system of FIG. 2B according to an exemplary embodiment.

As shown in FIGS. 3A and 3B, dividers 20*a*, 20*b* may be further provided with a slot 50*a*, 50*b* (which may be a slot, channel, track, guide, pusher track, etc.) for receiving a pusher assembly 60*a*, 60*b* or other product biasing mechanism (e.g., arm, rod, member, puller, etc.). It should be noted that the various embodiments of the merchandising system shown may be used with any type of panel or divider sections (or partitions), including merchandising systems that does not employ pushers or product biasing mechanisms (e.g., system 10*c*). According to various other exemplary embodiments, the slot may be omitted (e.g., system 10*c*).

Dividers 20*a*, 20*b* include guides 78*a*, 78*b* (e.g., runners, tabs, ribs, supports, etc.) located along the sides of dividers 20*a*, 20*b*. According to an exemplary embodiment, guides 78*a*, 78*b* are coupled to (e.g., attached to, affixed to, etc.) dividers 20*a*, 20*b*. Guides 78*a*, 78*b* have an overall circular cross-section with a substantially hollow interior portion 84*a*, 84*b*. According to alternative embodiments, the guides may have a cross section of any other suitable shape (e.g., oval, triangular, rectangular, etc.) that will allow articles to be positioned on the shelf. Guides may be used to direct (e.g., guide) the articles along the shelf as they are dispensed. According to an exemplary embodiment, guides 78*a*, 78*b* provide at least some resistance to prevent sliding of the article when not being dispensed or to slow the dispensing of articles. According to various embodiments, the guides may be integrally formed with the sides of the frame. According to various alternative embodiments, the guides may be formed separately and then connected to the frame by suitable attachment process (e.g., gluing, taping, adhering, sonic welding, etc.).

Figure 3C:
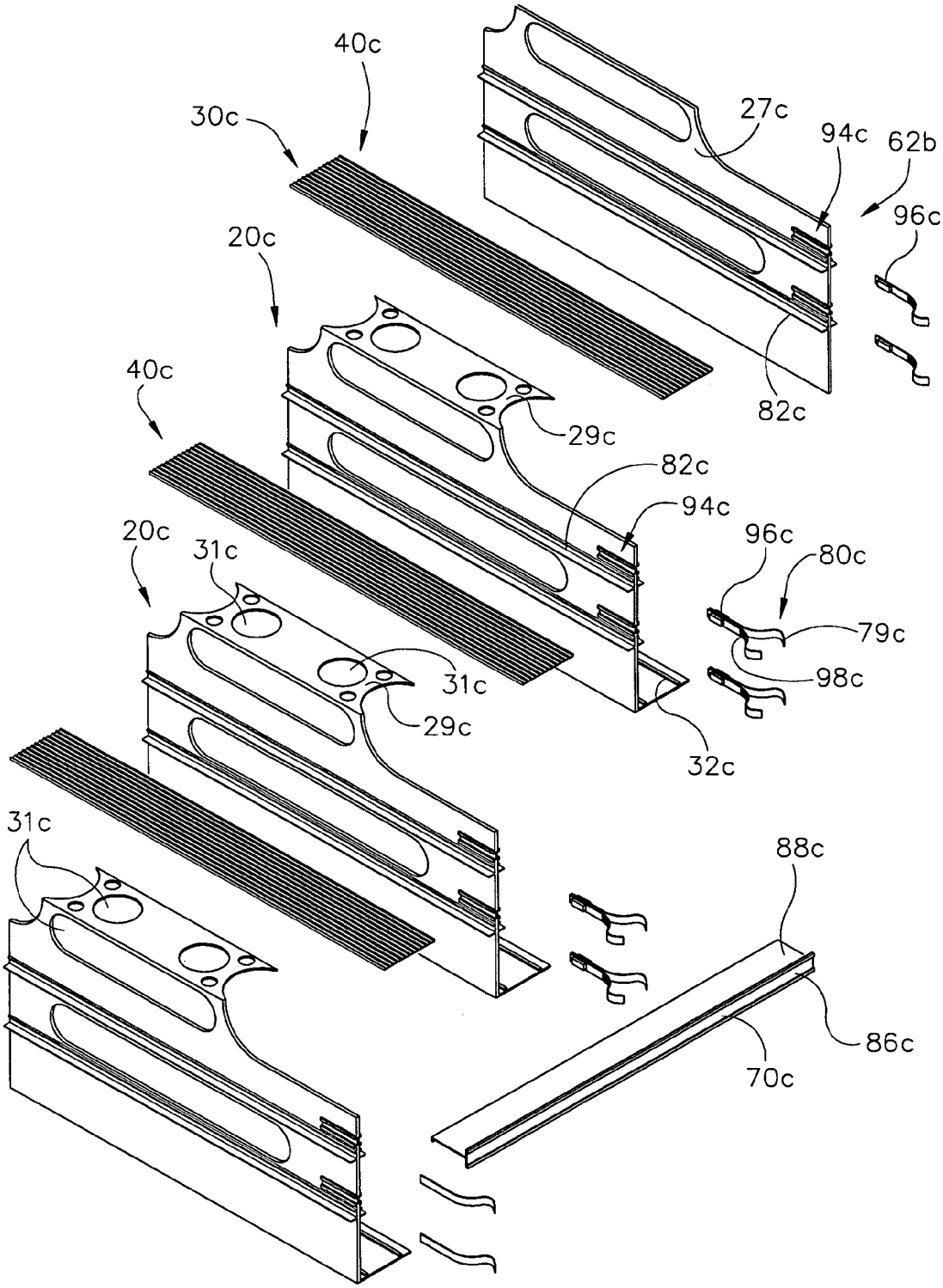
FIG. 3C is an exploded front perspective view of the merchandising system of FIG. 2C according to an exemplary embodiment.
Figures 6A, 6B:
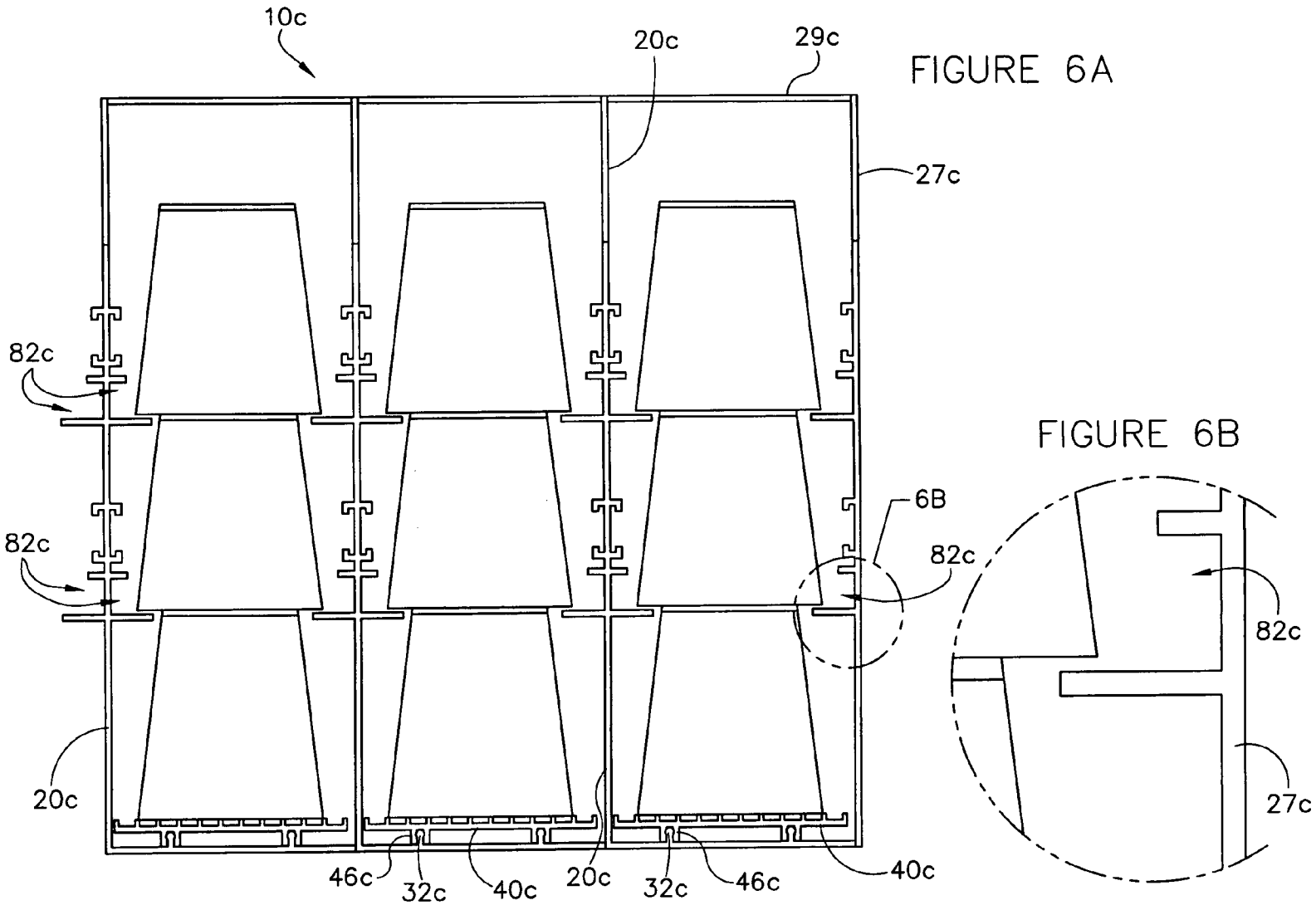
FIG. 6A is an orthogonal front view of the merchandising system of FIG. 2C according to an exemplary embodiment.
FIG. 6B is a detailed view of a portion of the merchandising system of FIG. 6A according to an exemplary embodiment.

According to an alternative embodiment shown in FIGS. 2C, 3C, and 6B, guides 78*c* include channels or tracks 82*c*. Tracks 82*c* are intended to provide additional support for products that slide along the system. According to a preferred embodiment shown in FIGS. 2C, 6A, 6B and 8C, a second product (shown as yogurt container 81*c*) is supported entirely by a first product (shown as yogurt container 83*c*). As each product slides along the system, the second product may become unstable. Tracks 82*c* provide support to a lower portion of the second product to maintain stability of the second product and prevent the second product from falling over. According to alternative embodiments, the tracks may completely and/or at least partially support the products when provided in the system.

Connectors 40*a* (shown in FIGS. 2A, 3A, 4A, 4B, 7A, and 8A), 40*b* (shown in FIGS. 2B, 3B, 5A, 5B, 7B, and 8B), 40*c* (shown in FIGS. 2C, 3C, 6A, 6B, 7C, and 8C) of merchandising systems 10*a*, 10*b*, 10*c* may be flat elongated members (which may be a web, mat, etc.). As shown in FIGS. 4A–4B, 5A–5B, and 6A–6B, connectors 40*a*, 40*b*, 40*c* may be provided with a series of grooves 46*a*, 46*b*, 46*c* (which may be notches, grooves, cuts, etc.) thereby forming a series of teeth 44*a*, 44*b*, 44*c* (which may be projections, extensions, etc.). According to various alternative embodiments, a connector may be provided with a series or index of grooves along a portion (either width or length) of the connector (i.e., provided along a partial width or partial length of the connector). According to various alternative embodiments, grooves may be provided at any desired spacing, with any desired number of grooves.

Connectors 40*a*, 40*b*, 40*c* configured to coact (e.g., receive, couple, engage or otherwise connect) with dividers 20*a*, 20*b*, 20*c*. As shown in FIGS. 4A–4B, 5A–5B, and 6A–6B, the width of grooves 46*a*, 46*b*, 46*c* is approximately equal to the width of legs 34*a*, 34*b*, 34*c* on dividers 20*a*, 20*b*, 20*c*. Legs 34*a*, 34*b*, 34*c* are intended to provide for a more secure engagement between the connectors 40*a*, 40*b*, 40*c* and dividers 20*a*, 20*b*, 20*c*, by "snapping" or projecting into recess or grooves 46*a*, 46*b*, 46*c*. According to an exemplary embodiment, the projections are slightly rounded along a bottom edge so that they may "snap" into the slots on the connectors. For example, grooves 46*a*, 46*b*, 46*c* include "teeth" or extensions 44*a*, 4*b*, 44*c* along the upper portion that are configured to grip rounded edges 36*a*, 36*b*, 36*c* of legs 34*a*, 34*b*, 34*c*.

As shown in FIGS. 4A–4B, 5A–5B, and 6A–6B, connector 40*a* engages the bottom side of dividers 20*a* whereas connectors 40*b*, 40*c* engage the upper side of dividers 20*b*, 20*c*. Connectors 40*b*, 40*c* are intended to extend substantially the length of dividers 20*b*, 20*c*. This configuration advantageously allows products to slide along an entire solid surface. Connectors 40*b*, 40*c* are provided with friction reducing ribs or protrusions (shown as ribs 30*b*, 30*c*). Ribs 30*b*, 30*c* provide friction reduction on a product support surface such that product which is being displayed or supported on merchandising system 10*a* may move more easily along the length of connector 40*b*, 40*c*.

According to an alternative embodiment, the connector may be provided with a series of straight grooves and teeth. According to other various alternative embodiments, a variety of shapes, sizes, spacings, arrangements, and other configurations may be provided with the connector. According to various alternative embodiments, the connector may comprise tabs or teeth that interlock with the dividers in predetermined locations, thereby adjusting the distance between dividers. According to various other embodiments, the connector may comprise slide mechanisms that enable the divider to slide from one position to another. According to various other embodiments, the connector may comprise any other suitable mechanism for adjusting the divider position, configuration, orientation, etc.

Connectors 40*a*, 40*b*, 40*c* may be provided in one or a variety of unit sizes (e.g., length or width) or shapes (e.g., orthogonal or diagonal or curved). According to a particularly preferred embodiment, connector 40*a* has a length in the range of about 2 to 8 inches. According to another particularly preferred embodiment, connector 40*a* has a length of about 2 to 4 inches. Alternatively, the connector may be provided in (or may be "field-cut" to) a variety of lengths or sizes which allow for the connectivity and/or interface with dividers. According to an exemplary embodiment, connectors 40*b*, 40*c* have lengths in the range of about 10.0 inches to 36.0 inches. According to a preferred embodiment, connectors 40*b*, 40*c* have lengths in the range of about 14 inches to about 26 inches.

One or more connectors may be provided between adjacent dividers. Providing one connector between adjacent dividers allows the connector to be easily accessed from the front, thereby allowing for adjustment to be accomplished relatively easily. Providing two connectors between adjacent dividers provides for added stability between adjacent dividers.

According to an exemplary embodiment shown in FIGS. 2A through 3C, a display portion or device 70*a*, 70*b*, 70*c* may be attached to shelving systems 10*a*, 10*b*, 10*c* for displaying information about the articles (e.g., price, manufacturer, bar code, etc.). As shown in FIGS. 2A through 3C, display portions 70*a*, 70*b*, 70*c* include a front slot or channel 86*a*, 86*b*, 86*c* configured to receive graphics, pricing, bar codes, and/or other information. Channels 86*a*, 86*b*, 86*c* are configured to provide a "stop" for products that are located at the front of the systems. As products advance toward the front of the systems, the products reach channels 86*a*, 86*b*, 86*c* provide a surface for at least partially restraining movement of the products. According to an exemplary embodiment, the lower portions of products rest against the display portions. Display portions 70*a*, 70*b*, 70*c* include back portions 88*a*, 88*b*, 88*c* which are intended to lay on the shelf. According to various embodiments, any suitable device or method may be used to secure the display portion to the shelving system (e.g., gluing, taping, adhering, fastening, etc.). According to an exemplary embodiment, the display portion may be integrally formed with the shelf, divider, and/or connector.

According to an exemplary embodiment shown in FIGS. 2A through 3C and 9A through 9B, a tab 80*a*, 80*b*, 80*c* (e.g., front stop, stopper, block, obstruction, plug, cap, etc.) is provided with dividers 20*a*, 20*b*, 20*c* that couples to (e.g., connects to, attaches to, is affixed to, etc.) front ends 62*a*, 62*b*, 62*c* of dividers 20*a*, 20*b*, 20*c*. As shown in FIGS. 2A, 2B, 3A, and 3B, tabs 80*a*, 80*b* are attached to guides 78*a*, 78*b*, (e.g., in interior hollow portions 84*a*, 84*b* of guides 78*a*, 78*b*) by way of a fastening device (shown as screw 92*a* in FIG. 9A) such as a nail, screw, clip, etc. The tab may be coupled to the divider according to any suitable device or method, and may be formed separately or integrally with the divider. According to an alternative embodiment shown in FIGS. 2C, 3C, and 9B, tab 80*c* attaches to divider 20*c* by sliding into a channel 94*c* located on divider 20*c*. Tab 80*c* includes two members 96*c* configured to fit within channels 94*c* positioned on each side of divider 20*c*. Tab 80*c* is held in place by friction between members 96*c* and channels 94*c*. Ridges may be included on the members and/or the channels to increase resistance. As shown in FIGS. 2A through 3C and 9A through 9B, tabs 80*a*, 80*b*, 80*c* include gripped surfaces 98*a*, 98*b*, 98*c*. Gripped surfaces 98*a*, 98*b*, 98*c* allow articles to be dispensed as desired by providing enough resistance to keep the articles from inadvertently sliding from the merchandising system.

Figure 7A:
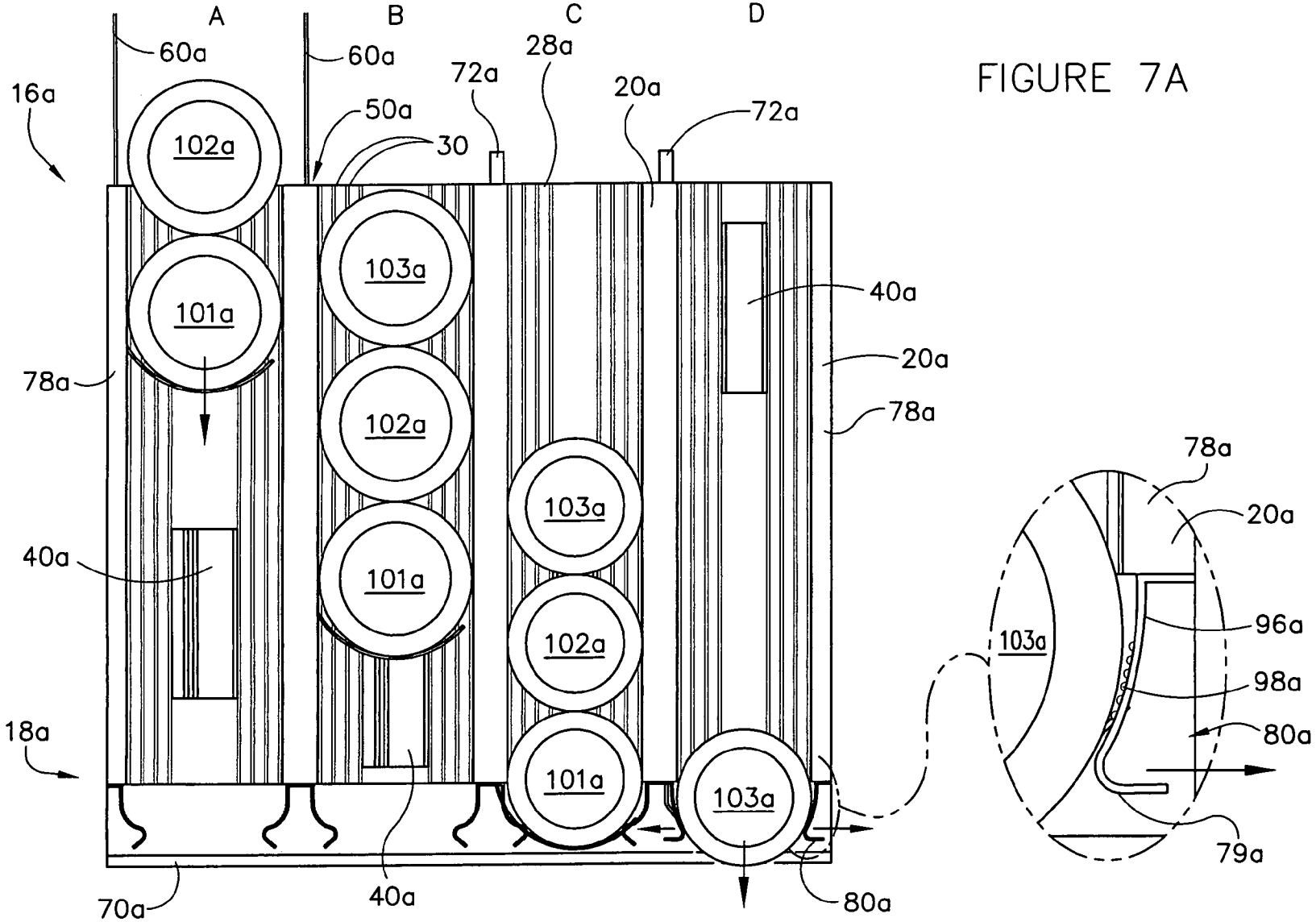
FIG. 7A is an orthogonal top view of the merchandising system of FIG. 2A according to an exemplary embodiment.
Figure 7B:
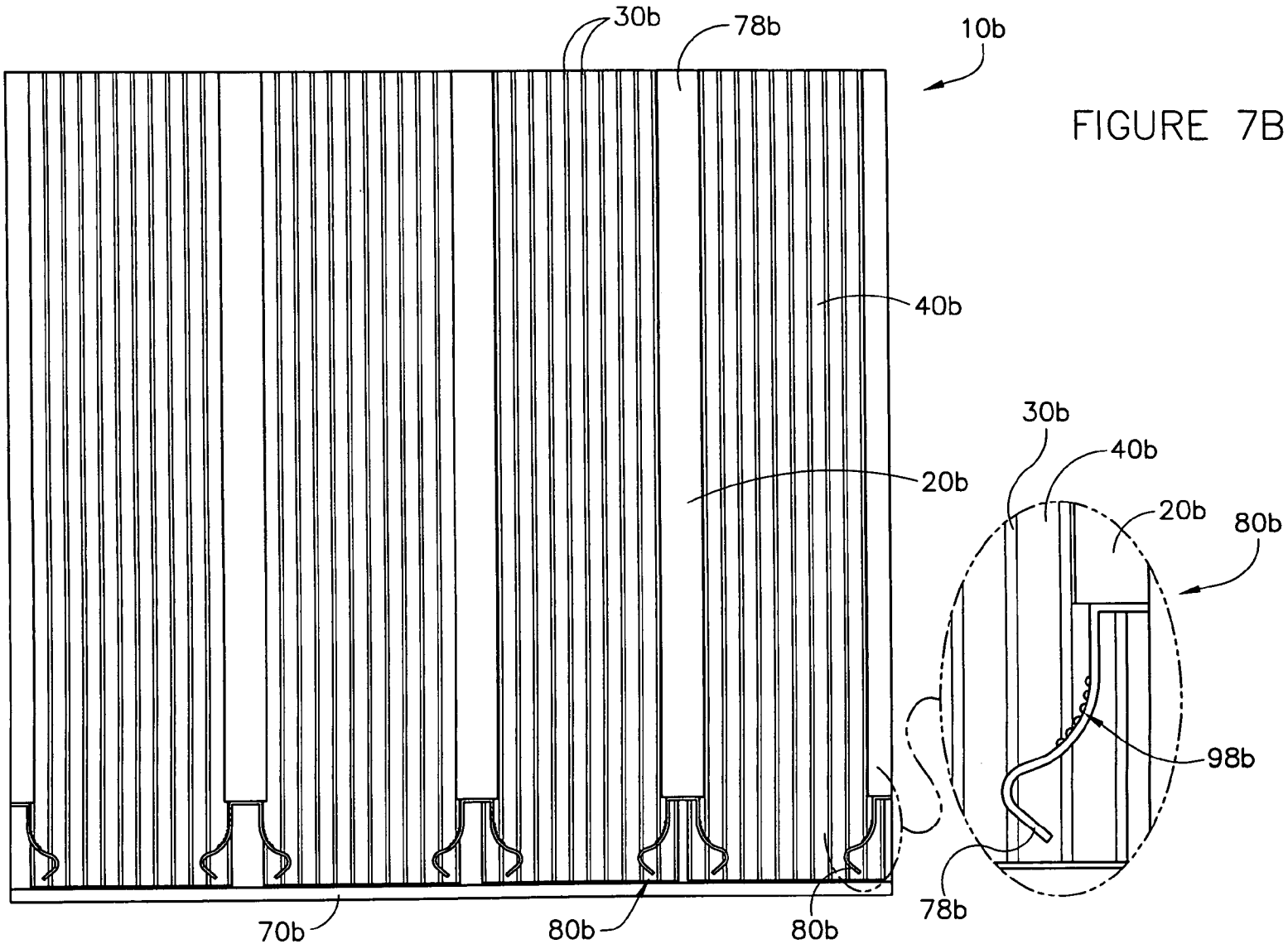
FIG. 7B is an orthogonal top view of the merchandising system of FIG. 2B according to an exemplary embodiment.
Figure 7C:
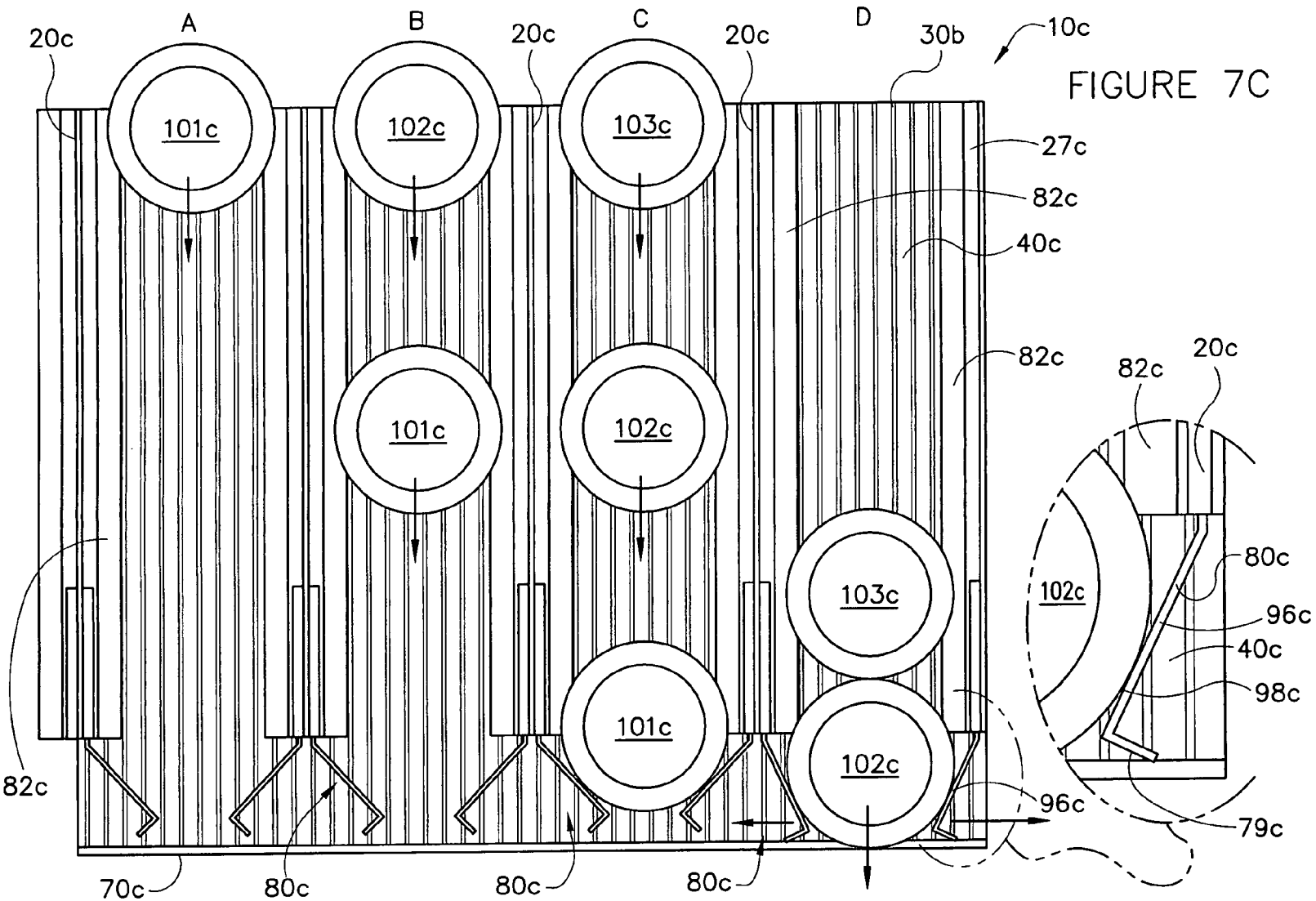
FIG. 7C is an orthogonal top view of the merchandising system of FIG. 2C according to an exemplary embodiment.

Tab 80*a*, 80*b* is preferably configured such that it restrains the movement of articles being dispensed or urged forward by gravity. According to an exemplary embodiment, tabs 80*a*, 80*b*, 80*c* include an outer curved portion 79*a*, 79*b*, 79*c* configured to provide a return angle for easy reloading of the system. According to an exemplary embodiment, the tabs provided on the divider provide resistance against force applied by the pusher assembly urging articles toward the front of the shelf. In the illustrated embodiment, the tabs are configured such that the removal of an article from the shelf requires more force than the angle of the shelf provides. As shown in FIGS. 7A and 7C, as articles are removed through tabs 80*a* and 80*c*, members 96*a* and 96*c* move in the direction of the arrows (yogurt containers 103*a*, 102*c* at sections "D"). When products are stocked and/or returned through the members, outer curved portions 79*a*, 79*c* move in the direction of the arrows to allow the product to be placed in the system. The angle of the shelf provides enough force to overcome the friction that may be present between the articles and the shelf, thereby enabling movement of the articles toward the first end of the shelf. According to alternative embodiments, other members may be provided to restrain such movement.

According to an exemplary embodiment, pusher assembly 60*a*, 60*b* (e.g., follower, puller, plate, hook, pull tab, paddle, pusher, biasing device, etc.) is provided with systems 10*a*, 10*b*. Pusher assemblies 60*a*, 60*b* are provided for use with merchandising systems 10*a*, 10*b* for urging articles in one direction or another. According to exemplary embodiments shown in FIGS. 2A, 2B, 3A, and 3B, pusher assemblies 60*a*, 60*b* include plates 64*a*, 64*b* (e.g., hooks, pullers, tabs, etc.) and members 66*a*, 66*b* (e.g., rods, extensions, arms, etc.). According to a preferred embodiment, plates 64*a*, 64*b* and members 66*a*, 66*b* are integrally formed as one piece. According to various other embodiments, the plate and member may be formed separately and then attached according to any suitable method (e.g., gluing, taping, adhering, etc.). According to an exemplary embodiment shown in FIGS. 2A, 2B, 3A, and 3B, pusher assemblies 60*a*, 60*b* are provided for contacting, coacting, biasing, pushing and/or pulling articles placed in merchandising systems 10*a*, 10*b*. According to alternative embodiments, the pusher assembly may be provided in a variety of sizes and shapes depending on the particular needs associated with the overall merchandising system.

Figures 10A, 10B, 10C:
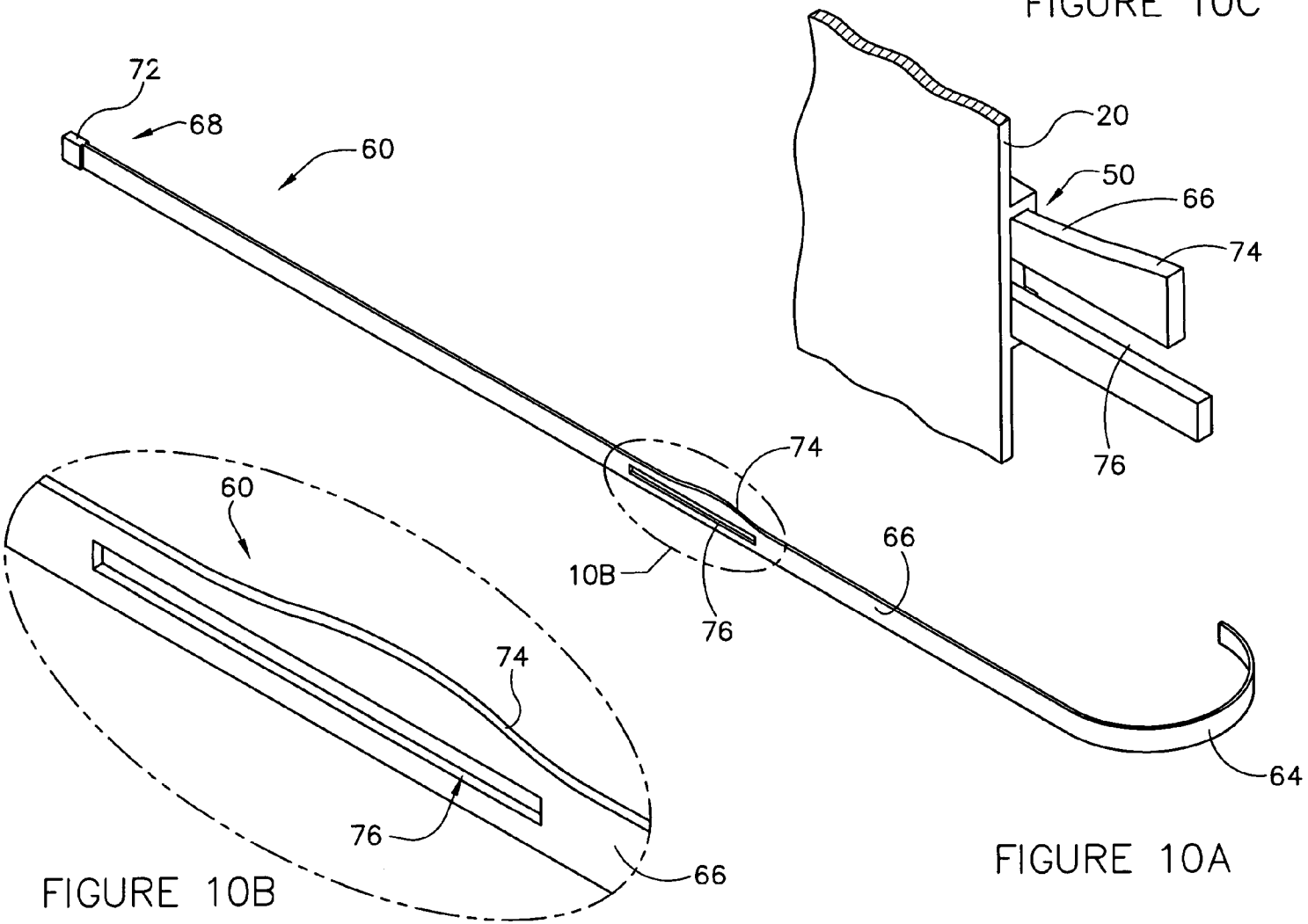
FIG. 10A is a front perspective view of a pusher assembly according to an exemplary embodiment.
FIG. 10B is a detailed front perspective view of the pusher assembly according to an exemplary embodiment.
FIG. 10C is a detailed perspective view of the pusher assembly positioned in a slot according to an exemplary embodiment.

According to an exemplary embodiment shown in FIGS. 2A, 2B, 3A, and 3B, pusher assemblies 60*a*, 60*b* include members 66*a*, 66*b* which slide through a slot or channel 50*a*, 50*b* of dividers 20*a*, 20*b*. According to an exemplary embodiment, pusher assemblies 60*a*, 60*b* are configured to move (and thereby pull articles) toward a rear 16*a*, 16*b* of merchandising systems 10*a*, 10*b*. According to alternative embodiments, the member may be attached to the guide by any other suitable arrangement such as fasteners, screws, rivets, bolts, snaps, clips, clamps or other various connectors or connection methods. As shown in FIGS. 3A and 3B, members 66*a*, 66*b* may include a handle 72*a*, 72*b* at an end 68*a*, 68*b* of members 66*a*, 66*b*. Handles 72*a*, 72*b* act to prevent members 66*a*, 66*b* from sliding too far along slots 50*a*, 50*b* because handles 72*a*, 72*b* are configured to be larger than the diameter of slot openings at the rear of the dividers. As shown in FIGS. 10A through 10C, members 66*a*, 66*b* include a raised portioned 74*a*, 74*b* (which may be a bump, extension, etc.) configured to provide tension against slots 50*a*, 50*b* as members 66*a*, 66*b* are slid through slots 50*a*, 50*b*. According to an exemplary embodiment, members 66*a*, 66*b* include apertures or openings 76*a*, 76*b*. Openings 76*a*, 76*b* are located adjacent to raised portions 74*a*, 74*b* to provide some flexibility as raised portions 74*a*, 74*b* slide along slots 50*a*, 50*b*. Openings 76*a*, 76*b* are able to flex inward as members 66*a*, 66*b* are moved along slots 50*a*, 50*b*. According to an exemplary embodiment, pusher assemblies 60*a*, 60*b* may be provided with indicia (e.g., on the face) and may be provided in a variety of sizes and shapes to suit the application (e.g., product size).

Figure 12:
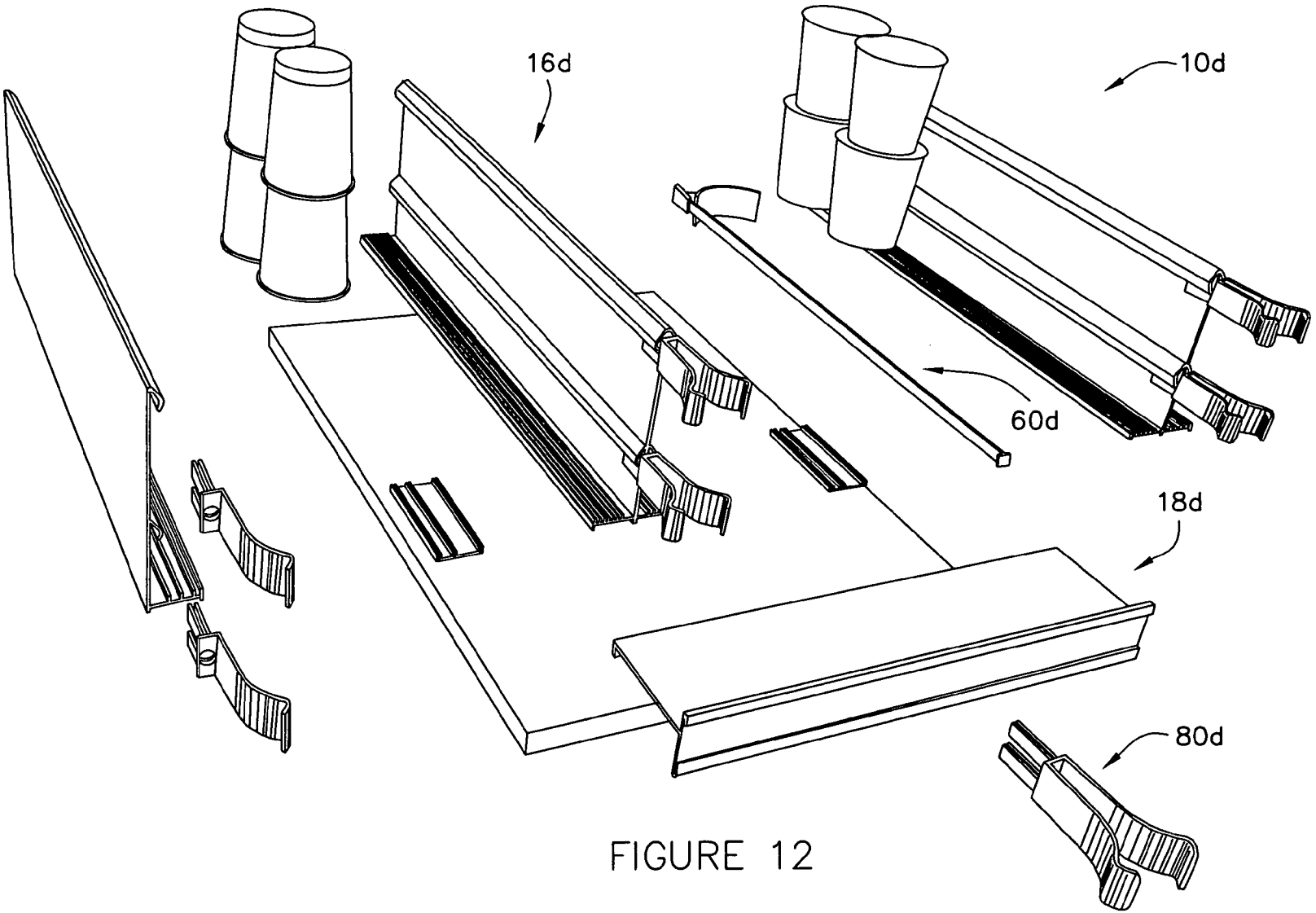
FIG. 12 is an exploded perspective view of a merchandising system according to an exemplary embodiment.

According to an alternative embodiment shown in FIG. 12, pusher assembly 60*d* is pulled toward a front 18*d* of system 10*d*. Preferably, system 10*d* is used with a substantially horizontal shelf so that pusher assembly 60*d* is used to pull articles toward front 18*d* to align products after supplies have been depleted by customers (e.g., less products left on the shelf). When stocking, articles are fed through tabs 80*d* at front 18*d* of system 10*d*. The articles push assembly 60*d* backwards toward a rear 16*d* of system 10*d*.

Figure 8A:
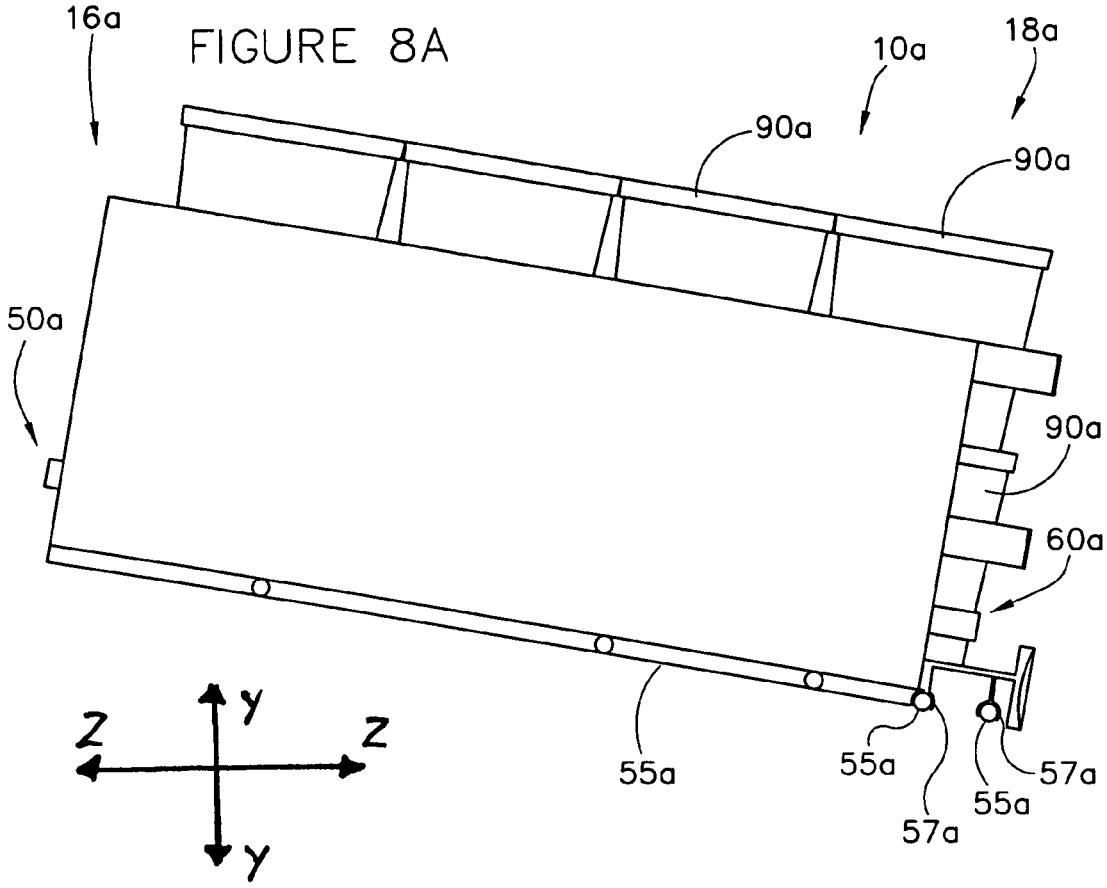
FIG. 8A is a side view of the merchandising system of FIG. 2A according to an exemplary embodiment.

According to an exemplary embodiment shown in FIG. 8A, articles 90*a* (shown as yogurt containers) may be stocked (e.g., loaded) in multiple layers (preferably two levels of yogurt containers) on merchandising system 10*a* along wire shelf supports 55*a*. System 10*a* includes wire connectors 57*a* for coupling or engaging wire shelf supports 55*a*. Wire connectors may be provided with any system described in this disclosure. Similarly, any number of systems may be provided on wire shelf supports. According to the exemplary embodiment shown in FIG. 8A, wire shelf supports 55*a* provide an overall downward angle with respect to the Z—Z axis. According to an exemplary embodiment, wire shelf supports 55*a* create an angle in the range of about 4 to 10 degrees with respect to the Z—Z axis (e.g., the horizontal). According to a preferred embodiment, wire shelf supports 55*a* creates an angle of about 6 to 8 degrees with respect to the Z—Z axis. This type of system may be stocked (e.g., loaded) in multiple layers with articles from either the front or rear of the merchandising system. According to a preferred embodiment, articles are stocked onto the merchandising system from rear end 16*a*. Before stocking the articles, pusher assembly 60*a* is pulled toward rear end 16*a* of system 10*a*. As articles 90*a* are loaded onto dividers 20*a*, pusher assembly 60*a* provides resistance or a biasing force against the articles so that each article does not slide in an uncontrolled manner toward front end 18*a* of system 10*a*. If the articles are free to slide toward front end 18*a*, the articles could tip over or fall from the merchandising system altogether. After dividers 20*a* have been fully (or partially loaded) as desired, pusher assembly 60*a* is positioned at font end 18*a* of system 10*a* by sliding pusher assembly 60*a* along slot 50*a*, thereby allowing articles 90*a* to slide to front end 18*a* as well. Pusher assembly 60*a* may then remain at front end 18*a* as articles are dispensed. This process may be repeated as necessary each time the shelf is stocked. (See FIG. 7A). According to an alternative embodiment, pusher assembly 60*a* is not utilized and guides 78*a* are intended to provide suitable resistance to prevent articles from tipping over or falling out of the system when sliding along connector 40*a*. Guides 78*a* are configured to provide support to the sides of articles loaded in the system as the articles advance.

Figure 8B:
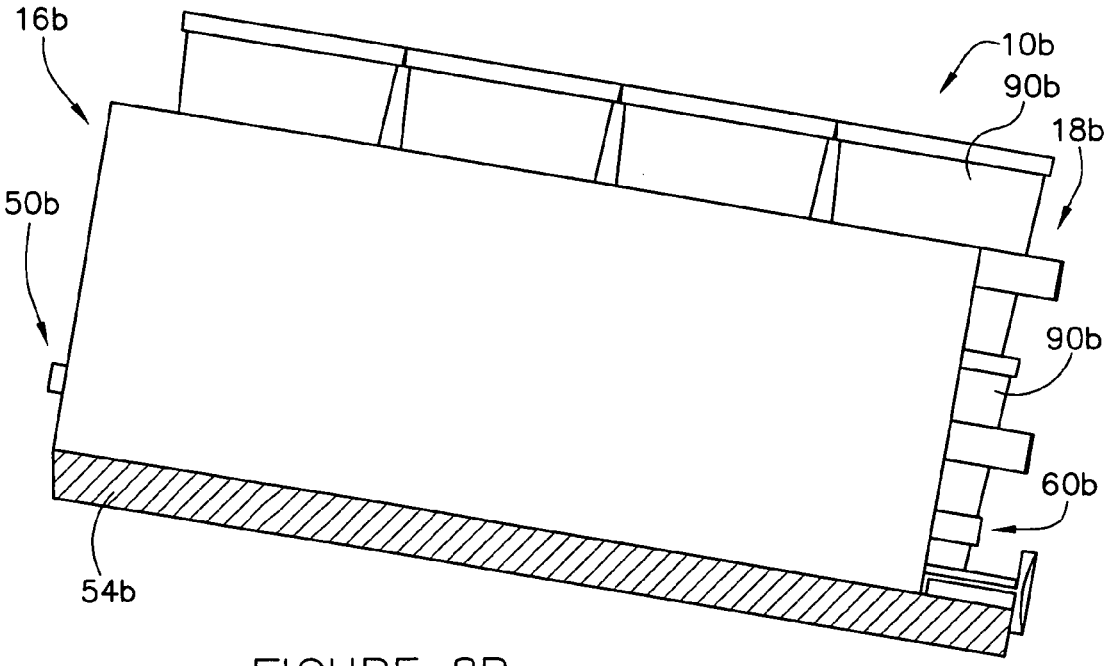
FIG. 8B is a side view of the merchandising system of FIG. 2B according to an exemplary embodiment.

According to a second embodiment shown in FIG. 8B, articles 90*b* (shown as yogurt containers) may be stocked (e.g., loaded) in multiple layers (preferably two or three levels of yogurt containers) on merchandising system 10*b* along shelves 54*b*. Shelf 54*b* is angled downward with respect to the Z—Z axis in FIG. 8B. According to an exemplary embodiment, shelf 54*b* is at an angle in the range of about 2 to 10 degrees with respect to the Z—Z axis (e.g., the horizontal). According to a preferred embodiment, shelf 54*b* is at an angle of about 4 to 7 degrees with respect to the Z—Z axis. This type of system may be stocked (e.g., loaded) in multiple layers with articles from either the front or rear of the merchandising system. According to a preferred embodiment, articles are stocked onto the merchandising system from rear end 16*b*. Before stocking the articles, pusher assembly 60*b* is pulled toward rear end 16*b* of shelf 54*b*. As articles 90*b* are loaded onto shelf 54*b*, pusher assembly 60*b* provides resistance or a biasing force against the articles so that each article does not slide in an uncontrolled manner toward front end 18*b* of system 10*b*. If the articles are free to slide toward front end 18*b*, the articles could tip over or fall from the merchandising system altogether. After shelf 54*b* has been fully (or partially loaded) as desired, pusher assembly 60*b* is positioned at font end 18*b* of shelf 54*b* by sliding pusher assembly 60*b* along slot 50*b*, thereby allowing articles 90*b* to slide to front end 18*b* as well. Pusher assembly 60*b* may then remain at front end 18*b* as articles are dispensed. This process may be repeated as necessary each time the shelf is stocked. According to an alternative embodiment, pusher assembly 60*b* is not utilized and guides 78*b* are intended to provide suitable resistance to prevent articles from tipping over or falling out of the system when sliding along connector 40*b*. Guides 78*b* are configured to provide support to the sides of articles loaded in the system as the articles advance.

Figure 8C:
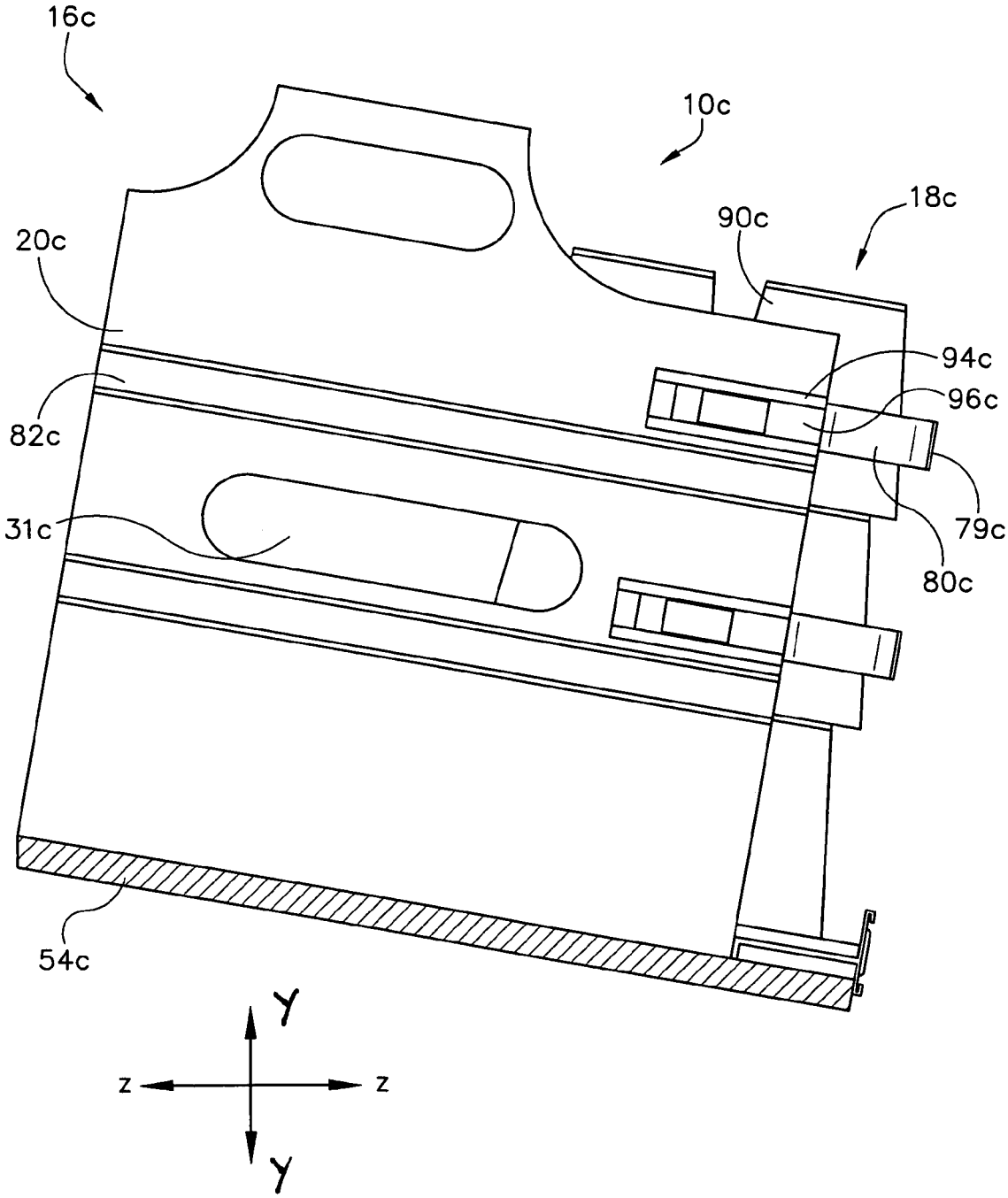
FIG. 8C is a side view of the merchandising system of FIG. 2C according to an exemplary embodiment.
Figure 9A:
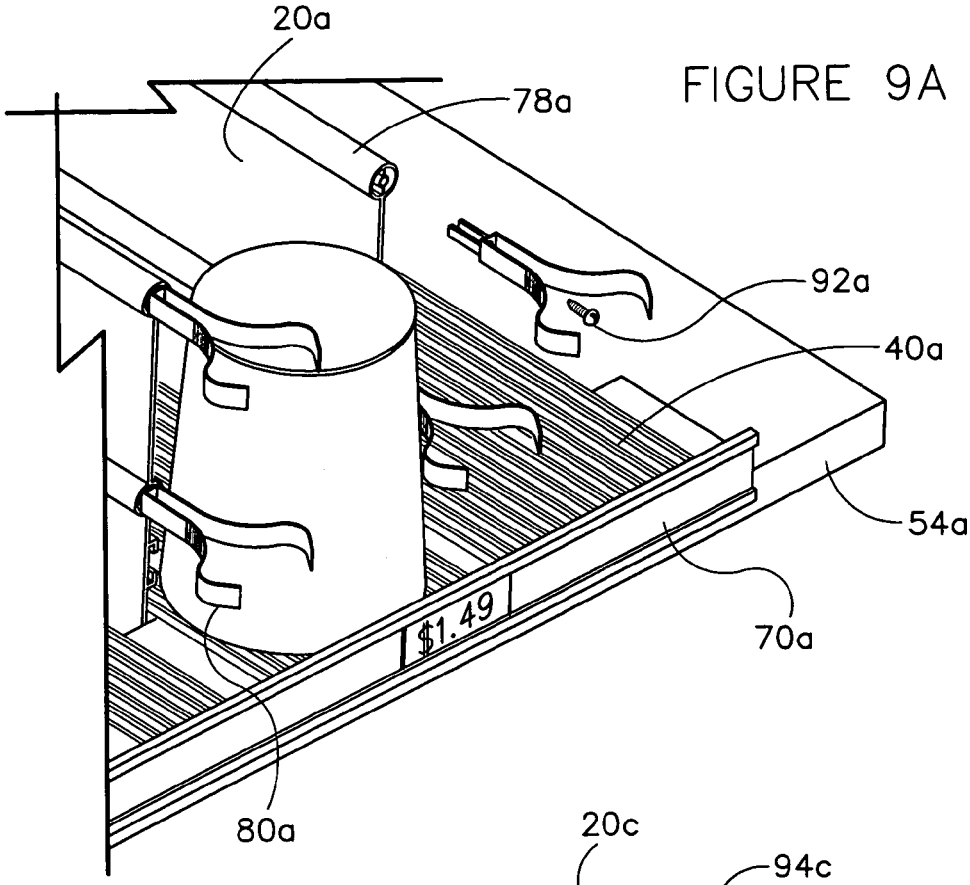
FIG. 9A is a front perspective view of a merchandising system comprising tabs according to an exemplary embodiment.
Figure 9B:
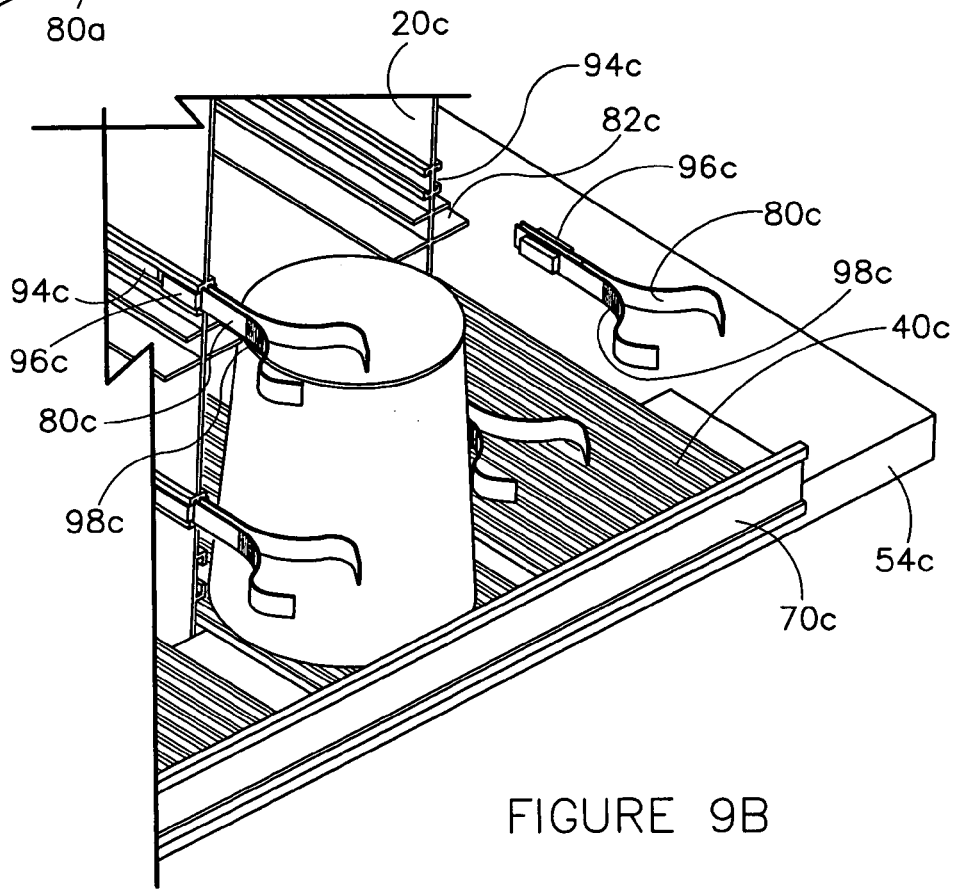
FIG. 9B is a front perspective view of a merchandising system comprising tabs according to an alternative embodiment.

According to a second embodiment shown in FIGS. 8C, articles 90*c* (shown as yogurt containers) may be stocked (e.g., loaded) in multiple layers (preferably three levels of yogurt containers) on merchandising system 10*c* along shelves 54*c*. Shelf 54*c* is angled downward with respect to the Z—Z axis in FIG. 8C. According to an exemplary embodiment, shelf 54*c* is at an angle in the range of about 2 to 10 degrees with respect to the Z—Z axis (e.g., the horizontal). According to a preferred embodiment, shelf 54*c* is at an angle of about 6 to 8 degrees with respect to the Z—Z axis. This type of system may be stocked (e.g., loaded) in multiple layers with articles from either the front or rear of the merchandising system. According to a preferred embodiment, articles are stocked onto the merchandising system from rear end 16c. Tracks 82*c* are intended to provide support if needed to prevent articles from tipping over or falling out of the system when sliding along connector 40*c*. Tracks 82*c* are configured to provide support to portions of articles loaded in that begin to tip over or fall out of the system as the articles advance. Under normal use, tracks 82*c* do not contact the articles (e.g., yogurt containers) which are completely supported by either connector 40*c* (e.g., the bottom yogurt container) or a yogurt container underneath a particular yogurt container. According to an alternative embodiment, a pusher assembly may be utilized to help prevent articles from sliding at an undesirable rate along the system.

According to various exemplary embodiments, the assemblies and components of the merchandising system may be constructed from a variety of suitable materials, including metals, metal alloys, aluminum, polymers, composites, plastics (including high impact plastics and injection molded plastic), ceramics, etc.

According to various exemplary embodiments, the frame system may be constructed from metal, metal alloys, aluminum, plastics, polymers, composites, etc. According to other alternative embodiments, any other suitable material may be used to construct the frame system. According to an exemplary embodiment, the frame system may be chrome plated to improve aesthetic appeal.

According to various exemplary embodiments, the shelf may be constructed from metal, metal alloys, aluminum, plastics, polymers, composites, etc. According to a preferred embodiment, the shelf is constructed from metal or metal alloys. According to alternative embodiments, any other suitable material may be used to construct the shelf. According to an exemplary embodiment, the shelf is approximately 10 to 30 inches wide and approximately 30 to 60 inches long. According to a preferred embodiment, the shelf is about 20 inches wide by about 48 inches long. According to an exemplary embodiment, the shelf is about 0.25 inch to about 1 inch thick. According to a preferred embodiment, the shelf is about 0.625 inch thick.

According to an exemplary embodiment, the shelves may be spaced at various distances from one another. For example, the shelves may be spaced about 6 inches to about 9 inches apart. According to a preferred embodiment, the shelves are spaced about 7 to 8 inches apart, thereby leaving about 4 to 7 inches of stocking space. This configuration provides an increase in the size of the bottom section.

The divider and pusher assembly may generally be made from injection molded plastic or from a variety of other plastics, polymers, composites, and processes (e.g., extrusion, cast, etc.). For example, the divider may be constructed from high-impact plastics, polymers, other plastics, and the like. The various components of the divider may be formed separately and then connected using a sonic welding process (or other suitable attachment technique). Using plastic offers several advantages including that the pieces are moldable in a variety of different colors, surface finishes, textures, etc. According to an exemplary embodiment, some or all of the components may be clear (e.g., opaque) to show products within the system. Other suitable materials (including metal, metal alloys, aluminum, etc.) may be used according to alternative embodiments. According to various exemplary embodiments, each component of the divider and pusher assembly may be sized to operate with various sized yogurt containers. For example, the pusher assembly may include a member that is approximately 48 inches long and a plate that is approximately 1 to 5 inches wide. According to various other embodiments, the member and plate may be any suitable size to operate with various sized articles.

According to one particularly preferred embodiment, the connectors are constructed from extruded plastic. According to one alternative embodiment, the connectors may be constructed from injection molded plastic. A variety of plastics may be used in constructing or assembling the connectors. For example, the connectors may be constructed or assembled from high-impact plastics, polymers, high-impact plastic. Using plastic offers several advantages including that the pieces may be constructed in a variety of different colors, surface finished, textures, etc. According to various alternative embodiments, a variety of other known or suitable materials may be used including metals, alloys, composites, etc.

According to one exemplary embodiment, the divider is constructed by co-extruding a material of a first rigidity (or flexibility) with a material of a second rigidity (or flexibility). According to an exemplary embodiment, the divider is a dual durometer extrusion having portions constructed from a rigid PVC, and portions constructed from a flexible, low tack, or "gummy" PVC. The friction material (such as a "gummy" material) assists the merchandising system to stay in place during use by increasing the friction between the divider and the support surface such as a shelf. Additionally, the friction portion helps to increase the engagement between the connector and the divider, thereby helping to prevent motion of the divider in a direction along the length of the divider. According to various exemplary embodiments, non-skid material, other friction material, non-skid feet (e.g., of rubber or another elastomeric material or the like) may be provided on the bottom of the merchandising system (including dividers and connectors).

According to the exemplary embodiment, the connector may also be constructed by co-extruding a material of a first rigidity (or flexibility) with a material of a second rigidity (or flexibility). According to an exemplary embodiment, the connector is a dual durometer extrusion having a portion (i.e., an upper portion) constructed from a rigid polyvinyl chloride (PVC), and another portion (i.e., a lower portion) constructed from a flexible, low tack, or "gummy" PVC. The portion constructed from a "gummy" material assists the merchandising system to stay in place during use by slightly adhering to a support surface such as a shelf. Similar extrusion processes may be used in the construction and assembly of other types of connectors.

As shown in the FIGURES, the merchandising system is intended to provide dividers that may be selectively adjusted. Products or merchandise may be placed between adjacent dividers. The merchandising system may allow the dividers to be reconfigured and resized for different sized divisions without the need to reconfigure or resize adjacent dividers. A "facing" or cell may be resized or have its width changed without needing to resize adjacent areas. This is an advantageous feature for a situation where one facing or cell needs to be resized for a different product size, but adjacent facings do not need to be so resized.

The merchandising system may be placed on top of shelves or shelving units. The merchandising system may simply rest on the top of a surface, or may be supported by feet on a shelf. According to exemplary embodiments, low-bond adhesives, soft-tack adhesives, plastics, polymers, elastomers, rubber (including craton rubber), other friction enhancing materials, etc. may be applied to restrict the motion of the merchandising system.

The various configurations of dividers and connectors shown in the FIGURES allow a user to pick and choose dividers for use in constructing merchandising systems. The different configurations allow for the same basic elements to be used in constructing a wide variety and sizes of merchandising system configurations. For example, one merchandising system configuration may require two end dividers, and three center dividers. Another merchandising system configuration may require two end dividers, five center dividers, etc. Any wide variety and configurations of dividers may be used to construct a merchandising system to meet various requirements such as space constraints, product sizes, etc.

The merchandising system may be constructed or assembled by pressing, snapping, engaging, placing, etc. the engaging portions of the dividers onto or with connectors. The connectors provide for a relatively simple connection between two divider panels. The dividers shown in the FIGURES may be readily adjusted. The dividers include legs (which may be interfaces, projections, extensions, etc.) that attach or couple to interfaces (such as notches, teeth, etc. on the connector). The dividers may be disconnected from an existing interface on the connector, and then attached or coupled with another interface at a different spacing. The merchandising system advantageously allows for selected dividers to be adjusted, resized, refaced and/or reconfigured without requiring the adjustment of adjacent dividers or divider sets.

Figure 11:
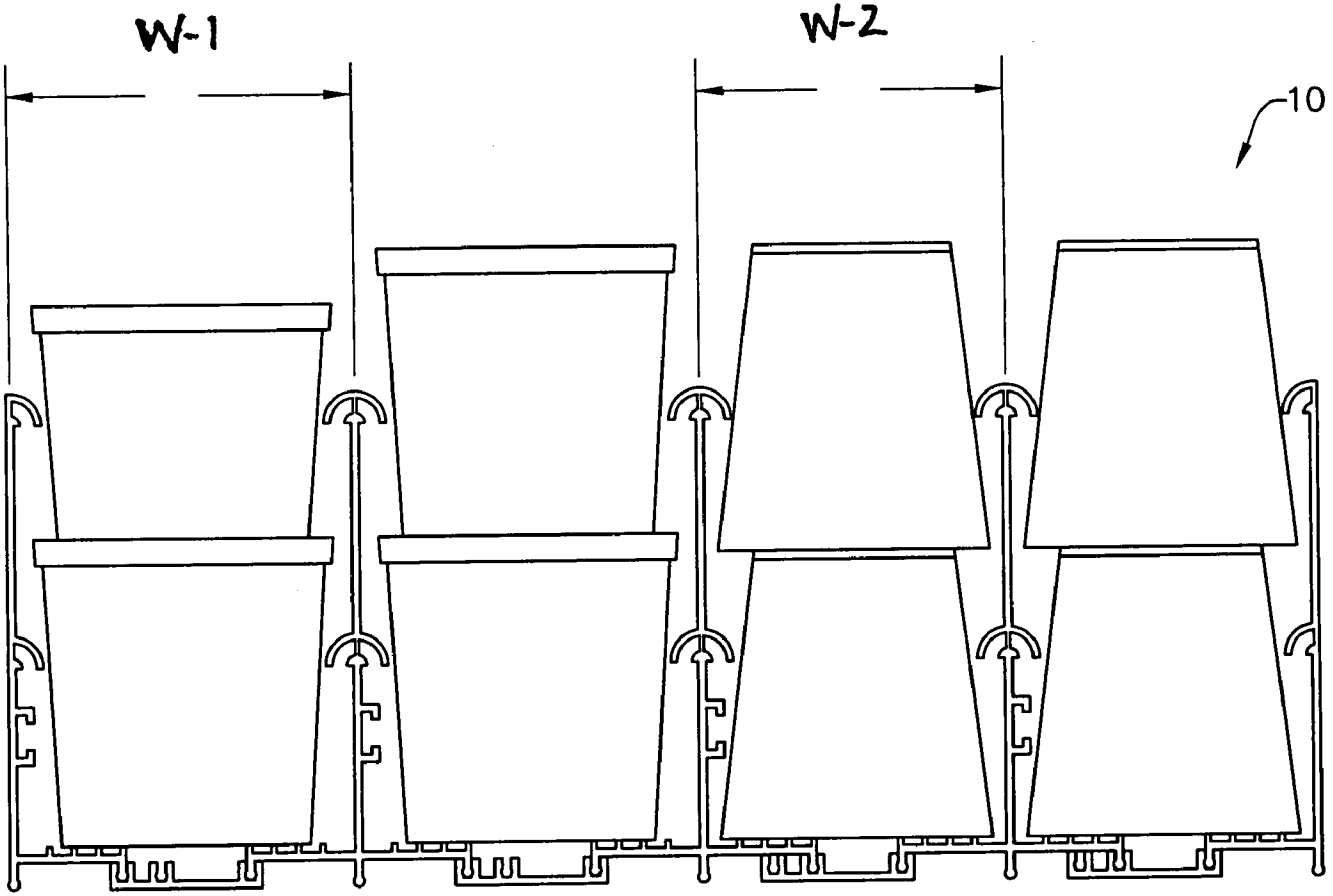
FIG. 11 is a front orthogonal view of a merchandising system according to an alternative embodiment.

In order for the merchandising system to be configured to display or fit specific products, manufacturers, set of products, etc., the merchandising system may be reconfigured to allow sizing for variously sized products, etc. As shown in FIG. 11, a first sizing or spacing (e.g., width) of dividers (indicated by "W-1") may be used for a first product, while a second sizing or spacing (e.g., width) of dividers (indicated by "W-2") may be used for a second product. According to one exemplary embodiment, connectors may be provided with a continuous, even distribution of interfaces (which may be notches, teeth, etc.). This configuration allows for a merchandising system that is configured to accommodate a wide variety of product sizes. According to one alternative embodiment, a connector may be provided with a limited number of interfaces set apart at predefined distances. For example, a connector (not shown) may be provided with three interfaces providing for three adjustment positions. This configuration may be provided for brand specific merchandising systems, having a predefined number of adjustment positions intended to correlate to a predefined number of products or product sets. According to alternative embodiments, any configuration, arrangement, sizing or distribution of interfaces may be provided.

It is also important to note that the construction and arrangement of the elements of the merchandising system as shown in the exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes, tolerances, and proportions of the various elements, values of parameters, mounting arrangements, use of materials, colors, orientations, etc.) without materially departing from the novel teachings and advantages of the subject matter of the present inventions. For example, elements shown as integrally formed may be constructed of multiple parts or elements show as multiple parts may be integrally formed. For example, a connector or connector portion of any of the exemplary or alternative embodiments could be made as an integral piece with a divider. The operation of the connection between the divider and connector may be reversed or otherwise varied, the shape or size (e.g., length or width) of the dividers or other elements of the system (e.g., shelf divider or interface of the divider members) may be varied, the nature or number of discrete adjustment positions provided on the connectors may be varied (e.g., by variations in the number of engagement points or size of the engagement points or type of engagement).

It should be noted that the elements and/or assemblies of the system may be constructed from any of a wide variety of materials that provide sufficient strength or durability, including any of a wide variety of moldable or extrudable plastic materials (such as high-impact plastic) in any of a wide variety of colors, textures and combinations. It should also be noted that the merchandising system may be used in association with a shelf (e.g., of a shelving unit or the like) or any of a wide variety of other surfaces in any of a wide variety of other applications. Accordingly, all such modifications are intended to be included within the scope of the present inventions.

The merchandising system may be to display and merchandise a variety of products, including containers, packages, bags, boxes, tubes, etc. The products may be food products, foodstuffs, snacks, prepared food packages, etc. Alternatively, other products of a variety of sizes and weights may be displayed and merchandised, such as consumer products, parts, batteries, automotive batteries, tissue boxes, etc.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the present inventions.

What is claimed is:

1. A merchandising system for articles comprising:

a connector;

a first divider having a front end, the first divider coupled to the connector;

a second divider having a front end, the second divider coupled to the connector; and members coupled to and extending outwardly from the front end of each of the first and second dividers;

wherein a compartment of a first size is provided between the first and second divider when the first divider is coupled to a first portion of the connector and the second divider is coupled to a third portion of the connector;

wherein a compartment of a second size is provided between the first and second divider when the first divider is coupled to a second portion of the connector and the second divider is coupled to the third portion of the connector;

wherein adjacent members coupled to the front end of each of the first and second dividers cooperate so as to at least partially restrain movement of the articles and so as to at least partially move to allow removal of articles provided in a compartment.

2. The merchandising system of claim 1 wherein the dividers comprise guides configured to provide support to the articles as the articles move between a rear of the compartment and a front of the compartment.

3. The merchandising system of claim 2 wherein the guides are integrally formed with the dividers.

4. The merchandising system of claim 2 wherein the guides are tracks.

5. The merchandising system of claim 2 wherein the guides comprise a substantially curved shape.

6. The merchandising system of claim 2 further comprising a member provided at the front of the system for displaying product information.

7. The merchandising system of claim 2 wherein the members are coupled to the guides.

8. The merchandising system of claim 7 wherein the members are generally curved in shape.

9. The merchandising system of claim 8 wherein the members comprise protrusions for gripping articles.

10. The merchandising system of claim 1 wherein the dividers comprise apertures.

11. The merchandising system of claim 1 further comprising a member having a substantially curved portion and slidably coupled to an inner wall of a divider and being movable with the articles.

12. The merchandising system of claim 11 wherein the member comprises a resilient portion for at least partially resisting movement of the articles moving between a rear and a front of the system.

13. The merchandising system of claim 1 wherein the first divider comprises a generally vertical wall and the second divider comprises a generally vertical wall, and wherein the first divider has a generally horizontal portion for coupling to the connector.

14. The merchandising system of claim 1 wherein the first divider is integrally formed and the connector is integrally formed and the first divider and the connector are configured to directly couple together.

15. The merchandising system of claim 1 wherein the connector further comprises a generally horizontal surface.

16. The merchandising system of claim 15 wherein the horizontal surface further comprises ribs.

17. The merchandising system of claim 1 wherein the compartment of the first size is formed by coupling the first divider to the connector with a first interface and the second divider to the connector with a third interface.

18. The merchandising system of claim 17 wherein the first interface comprises a portion of the first divider and the third interface comprises a portion of the second divider.

19. The merchandising system of claim 17 wherein the first interface comprises a portion of the connector and the third interface comprises a portion of the connector.

20. The merchandising system of claim 1 wherein the connector is directly coupled to the first divider.

21. The merchandising system of claim 1 wherein the compartment of the first size comprises a width defined by a distance between the first divider and the second divider.

22. The merchandising system of claim 1 wherein the connector couples to an upper portion of the dividers.

23. The merchandising system of claim 1 wherein a plurality of layers of stacked articles can be supported between the dividers.

24. The merchandising system of claim 1 wherein the articles are yogurt containers.

25. The merchandising system of claim 1 wherein the connector is shorter than the dividers.

26. The merchandising system of claim 1 wherein the compartment is configured:

to be provided in the first size so that the first divider is coupled to a first portion of the connector and the second divider is coupled to a third portion of the connector;

to be provided in the second size after being provided in the first size so that the first divider is coupled to a second portion of the connector and the second divider is coupled to the third portion of the connector; and to be returned to the first size after being provided in the second size so that the first divider is coupled to the first portion of the connector and the second divider is coupled to the third portion of the connector.

* * * * *